US011072471B2

(12) United States Patent
Poehls

(10) Patent No.: US 11,072,471 B2
(45) Date of Patent: Jul. 27, 2021

(54) LID FOR A CONTAINER AND CUTLERY PRODUCED FROM A LID OF THAT KIND

(71) Applicant: Spies Kunststoffe GmbH, Melle (DE)

(72) Inventor: Guido Poehls, Metzingen (DE)

(73) Assignee: Spies Kunststoffe GmbH, Melle (DE)

( * ) Notice: Subject to any disclaimer, the term of this patent is extended or adjusted under 35 U.S.C. 154(b) by 158 days.

(21) Appl. No.: 16/561,393

(22) Filed: Sep. 5, 2019

(65) Prior Publication Data

US 2020/0140161 A1 May 7, 2020

(30) Foreign Application Priority Data

Nov. 2, 2018 (DE) ..... 10 2018 127 380.0

(51) Int. Cl.
*B65D 51/24* (2006.01)
*B65D 77/24* (2006.01)
*A47G 21/04* (2006.01)

(52) U.S. Cl.
CPC ..... *B65D 51/247* (2013.01); *B65D 77/245* (2013.01); *A47G 21/04* (2013.01)

(58) Field of Classification Search
CPC .. B65D 51/246; B65D 51/247; B65D 77/245; A47G 21/04
USPC ..... 220/212; 229/401
See application file for complete search history.

(56) References Cited

U.S. PATENT DOCUMENTS 2,598,987 A 6/1952 Franzen
3,487,974 A * 1/1970 Schovee ..... B65D 51/246 220/212
4,060,176 A 11/1977 Tobiasson
4,393,988 A * 7/1983 Burke ..... A47G 21/04 229/125.03
5,419,049 A * 5/1995 MacArthur-Onslow ..... A47G 21/02 229/401
5,695,084 A 12/1997 Chmela et al.
6,371,324 B1 4/2002 Torniainen et al.
6,604,645 B1 8/2003 Vaupotic

FOREIGN PATENT DOCUMENTS

CN 204323961 U 5/2015
WO 2008/061080 A2 5/2008

* cited by examiner

*Primary Examiner* — James N Smalley
*Assistant Examiner* — Jennifer Castriotta
(74) *Attorney, Agent, or Firm* — Collard & Roe, P.C.

(57) ABSTRACT

A lid for a container, with a lid body includes a handling body having a lid outer edge and an eating utensil part. The eating utensil part hinge has a hinge spacing from the lid outer edge of the handling body. An eating utensil part engagement-behind support body of the first handling part is formed between the eating utensil part hinge or the eating utensil part hinge pivot axis and the lid outer edge of the handling body. The eating utensil part engagement-behind support body is opposite the eating utensil part in the eating use setting on a first eating utensil part side of the eating utensil part so that for acceptance of use forces acting in a first force direction the eating utensil part is or can be directly or indirectly supported on the eating utensil part engagement-behind support body.

15 Claims, 6 Drawing Sheets

LID FOR A CONTAINER AND CUTLERY PRODUCED FROM A LID OF THAT KIND

CROSS REFERENCE TO RELATED APPLICATIONS

Applicant claims priority under 35 U.S.C. § 119 of German Application No. 10 2018 127 380.0 filed Nov. 2, 2018, the disclosure of which is incorporated by reference.

BACKGROUND OF THE INVENTION

1. Field of the Invention

The invention relates to a lid for a container.

2. Description of the Related Art

Currently on the market are lids or closures with troughs which are closed by an adhesive label or a sealing foil and into which the desired items of cutlery have been inserted. The size of the trough predetermines the maximum size of the item of cutlery. As a consequence, the item of cutlery can be only as long as the largest dimension of the lid or closure. As an optimized solution for that purpose there are foldable items of cutlery or pluggable items of cutlery. Disadvantages of these known solutions are:

- several components of usually different materials (complete lid, complete cutlery);
- the individual components easily pass into the environment
- in part, several raw materials
- the items of cutlery can, in part, be introduced only in a second production step—costs, hygiene . . .
- the foldable solutions can be loaded substantially only in one direction, so as to avoid folding in or folding back
- doubled-layers of material mean greater consumption of material and correspondingly higher costs and a correspondingly greater degree of environmental harm.

There has become known from of U.S. Pat. Nos. 6,604,645 and 5,695,084 a removable lid for a container with a spoon which is integrated in a trough in a stiff lid body and which is connected by way of film hinge with an outer edge of the lid body and intended for the purpose of being separated from the lid body so as to be used as a separate spoon for eating a content of the container.

A removable lid for a container has become known from U.S. Pat. No. 6,371,324 B1, in which, in a stiff lid body, passages in which two spoon parts respectively connected by way of a plurality of frangible locations with the lid body are formed. These spoon parts are intended for the purpose of being separated from the lid body and combined to form a separate spoon in order to then be used for eating a content of the container.

A removable lid for a container has become known from U.S. Pat. No. 4,060,176, which consists of an elastic-flexible material and in which a spoon able to be folded out is integrated, the spoon being integrally connected with the lid body and of the same material. In order to fold out the spoon the lid has to be resiliently compressed by hand onto the lid edges which, as considered in a direction perpendicular to the spoon longitudinal axis, face away from one another and, in order to eat the content of the container, has to always be kept compressed so as to avoid folding back of the spoon. The base of this spoon is integrally connected in the region of pre-formed V-shaped fold lines with an inner edge of an encircling container engagement-over edge. The spoon base in the compressed state of the lid, in which the spoon projects out beyond the lid outer edge, is in fact supported on the outer edge of the container engagement-over edge, but the necessarily elastic-flexible material makes possible only use for eating foodstuffs of comparatively low viscosity. Apart from that, loading of the spoon is possible substantially only in a main direction.

Similar removable lids for containers have become known from U.S. Pat. No. 2,598,987 and WO 2008/061080 A2. In these lids, spoon parts are each connected by way of a respective arcuate or straight fold seam with the lid body, the seams being provided either directly at the outer edge of the lid body or at a small spacing outside the outer edge of the lid body. Only loading of the respective spoon substantially in a main direction is possible with these lids as well.

SUMMARY OF THE INVENTION

It is an object of the invention to avoid the disadvantages of the prior art, in particular to provide a lid and an eating utensil produced therefrom with the following advantages:

- simple capability of production (lid and eating utensil)
- easy handling (lid and eating utensil)
- no separate individual components (lid and eating utensil)
- low environmental loading (lid and eating utensil)
- high degree of stability or stiffness (lid and eating utensil)
- item of cutlery loadable in all directions (eating utensil)
- high degree of user friendliness (lid and eating utensil)
- no risk of folding in again or folding back of the item of cutlery at the time of use, even in the case of tough or frozen container contents (eating utensil)
- after use of the eating utensil, advantageous possibilities for conversion back to a lid or closure (for example protection of the container content from insects).

This object is fulfilled with respect to the container by the features according to the invention. Accordingly, the invention relates to a lid, particularly removable lid for a container, preferably portable container, particularly packaging container, for reception of contents such as comestibles, preferably foodstuffs, particularly higher viscosity or high-viscosity, tough and/or frozen contents such as, for example, soft cheese or ice-cream, with a lid body comprising a handling body, which has a lid outer edge, and an eating utensil part, particularly a spoon, fork or knife, which is integrally connected with the handling body via a rectilinearly extending eating utensil part hinge in such a way that the eating utensil part can be folded out, preferably through approximately 180 degrees, relative to the handling body about an eating utensil part hinge pivot axis of the eating utensil part hinge from a not-folded-out, non-use setting not intended for eating into an eating use setting which is for eating a content of a container and in which the eating utensil part extends in the direction of its eating utensil part longitudinal axis transversely or perpendicularly away from the eating utensil part hinge beyond the lid outer edge of the handling body, wherein the handling body comprises a plurality of handling parts of which a first handling part and a second handling part are integrally connected together via a rectilinearly extending first lid hinge in such a way that the second handling part is foldable relative to the first handling part about at least one first lid hinge pivot axis of the first lid hinge from a basic setting not intended for eating into a first handling setting in which the handling parts form a handle for manual operation of the eating utensil part, which is folded out into its eating use setting, for eating a content of the container, wherein at least one securing means for securing the handling parts, which are folded together to form a handle, against unintended folding back is provided, and wherein the eating utensil part hinge has a hinge spacing from the lid outer edge of the handling body, preferably as considered in a direction transverse or perpendicular to the eating utensil part hinge, wherein an eating utensil part engagement-behind support body of the first handling part is formed between the eating utensil part hinge or the eating utensil part hinge pivot axis and the lid outer edge of the handling body and wherein the eating utensil part engagement-behind support body is opposite the eating utensil part in the eating use setting on a first eating utensil part side of the eating utensil part so that for acceptance of use forces acting in a first force direction the eating utensil part is or can be directly or indirectly supported on the eating utensil part engagement-behind support body, and the second handling part is formed with a first eating utensil part engagement-over support body which in the first handling setting is opposite the eating utensil part in the eating use setting on a second eating utensil part side, which faces away from the first eating utensil part side, of the eating utensil part so that for acceptance of use forces acting in a second force direction opposite the first force direction the eating utensil part is or can be directly or indirectly supported on the first eating utensil part engagement-over support body.

According to a preferred variant of embodiment it can be provided that the eating utensil part has a hinge length and that the hinge spacing is at least the same size as or larger than the hinge length of the eating utensil part hinge. Particularly advantageous supporting and stability conditions can thereby be realized.

According to a preferred embodiment it can be provided that the eating utensil part in its not-folded-out, non-use setting not intended for eating is integrated in the lid body. As a result, the lid can be produced particularly simply and economically and demands comparatively little space.

According to a further preferred embodiment it can be provided that the first handling part is constructed as an eating utensil part receiving part with an eating utensil part receiving passage in which the eating utensil part, which is pivotably connected by way of the eating utensil part hinge with the eating utensil part engagement-behind support body of the first handling part of the handling body, in its not-folded-out, non-use setting not intended for eating is arranged. As a result the foregoing advantages can be realized to a particular extent.

According to a particularly preferred variant of embodiment it can be provided that the eating utensil part in its not-folded-out, non-use setting not intended for eating is completely surrounded by the lid outer edge of the handling body. As a result, in addition to the foregoing advantages a greater degree of stability of the lid can be achieved. Moreover, the eating utensil part then not only does not project beyond the lid outer edge, but also leaves the lid outer edge entirely free of contact, so that better and more secure handling results.

According to a preferred development it can be provided that the first lid hinge extends with interruption or without interruption continuously between a first outer edge part of the lid outer edge and a second outer edge part, which faces away from the first outer edge part of the lid outer edge. As a result, a greater degree of stability or stiffness and greater functional reliability can be achieved.

According to an embodiment it can be provided that the first lid hinge or the first lid hinge pivot axis extends parallel to the eating utensil part longitudinal axis or parallel to a center longitudinal axis of the first handling part. Improved handling and functional reliability can thereby be achieved.

According to a particularly preferred variant of embodiment it can be provided that the first lid hinge pivot axis extends perpendicularly to the eating utensil part hinge pivot axis. Even better handling and functional reliability can thereby be achieved.

According to an advantageous development it can be provided that the first lid hinge is a first lid film hinge. A particularly high degree of functionality and functional reliability together with particularly simpler and more economic capability of production can thereby be achieved.

According to an advantageous development it can be provided that the eating utensil part hinge is a film hinge. A particularly high degree of functionality and functional reliability together with particularly simpler and more economic capability of production can thereby be achieved.

According to a particularly preferred embodiment it can be provided that a first eating utensil part support body and a second eating utensil part support body are arranged at the first handling part in the region of the lid outer edge of the handling body or at the lid outer edge of the handling body at a longitudinal spacing from the eating utensil part hinge to respectively adjoin the eating utensil part engagement-behind support body and as considered in a direction parallel to the eating utensil part hinge at a mutual transverse spacing the same size as or slightly larger than an eating utensil part width which the eating utensil part has in the longitudinal spacing from the eating utensil part hinge, or that a first eating utensil part support body and a second eating utensil part support body are arranged at the second handling part in the region of the lid outer edge of the handling body or at the lid outer edge of the handling body at a longitudinal spacing from the eating utensil part hinge to respectively adjoin the eating utensil part engagement-over support body and as considered in a direction parallel to the eating utensil part hinge at a mutual longitudinal spacing the same size as or slightly larger than an eating utensil part width which the eating utensil part has in the longitudinal spacing from the eating utensil part hinge or that a first eating utensil part support body is arranged at the first handling part in the region of the lid outer edge of the handling body or at the lid outer edge of the handling body at a longitudinal spacing from the eating utensil part hinge to adjoin the eating utensil part engagement-behind support body and that a second eating utensil part support body is arranged at the second handling part in the region of the lid outer edge of the handling body or at the lid outer edge of the handling body at a longitudinal spacing from the eating utensil part hinge to adjoin the eating utensil part engagement-over support body, wherein the first eating utensil part support body and the second eating utensil part support body in the handling setting in which the first handling part and the second part are folded to form a handle are, as considered in a direction parallel to the eating utensil part hinge, arranged at a mutual transverse spacing the same size as or slightly larger than an eating utensil part width which the eating utensil part has in the longitudinal spacing from the eating utensil part hinge. As a result, there is the possibility of even better support of the eating utensil part against lateral use forces than is possible due to the rectilinearly extending eating utensil hinge.

According to a particularly preferred variant of embodiment it can be provided that attached to the eating utensil part engagement-behind support body of the first handling part is a support pin which extends transversely or perpendicularly away, preferably with a conical taper, from an inner surface of the eating utensil part engagement-behind support body up to its free pin end and that the eating utensil part has an eating utensil part passage for reception of a pin part of the support pin, through which in the eating use setting of the eating utensil part the pin part of the support pin extends so that in the eating use setting of the eating utensil part the eating utensil part is either supportable on the pin by way of passage edges of its eating utensil part passage or is supported on the support pin by way of passage edges of its eating utensil part passage. As a result there is the possibility of even better support of the eating utensil against lateral use forces and use moments than is possible solely by way of the eating utensil hinge.

According to a preferred development provision can be made for fixing means for fixing the eating utensil part in a non-use setting against unintended folding out from the eating utensil part receiving passage of the first handling part, and/or for repeated fixing of the eating utensil part after it has been folded out from the eating utensil part receiving passage, to be provided.

According to a particularly preferred embodiment the lid body can consist of a plastics material, preferably thermoplastic plastics material, particularly of polypropylene, or of another inherently stiff or intrinsically stable material.

According to a preferred variant the lid body can be produced in an injection-molding method.

According to an advantageous embodiment provision can be made to provide a cover which covers the eating utensil part and the handling body together or individually at the upper side in sterile manner and which is either connected by way of a manually releasable adhesion connection with the handling body and with the eating utensil part or is connected with the handling body at least partly by way of a non-detachable connection and either freely bears against the eating utensil part or adheres to the eating utensil part to be manually releasable. These measures are particularly advantageous when the eating utensil part reaches to the upper side of the lid, thus forms, together with the handling body, the lid upper side. Advantageous hygienic conditions can thereby be created.

According to a preferred embodiment it can be provided that the cover is a cover foil. Weight and production costs can thus be saved, in company with reduced environmental loading.

According to a particularly preferred embodiment it can be provided that the detachable connection of the cover with the lid body is effected in one working step with the production of the lid body. For this purpose, production of the lid together with the cover can be carried out particularly advantageously in a so-called in-mold method, particularly by a so-called in-mold labelling method (IML method).

According to a preferred embodiment it can be provided that the lid and the cover consist of the same plastics material, preferably thermoplastic plastics material, particularly polypropylene. Category-pure recycling can thereby be guaranteed. However, it is also possible for the lid, optionally together with the cover, to be produced from different materials, preferably similarly in a one-step process.

According to a particularly preferred embodiment it can be provided that the handling body comprises a third handling part, which is integrally connected by way of a rectilinearly extending second lid hinge with the first handling part in such a way that the third handling part is foldable relative to the first handling part about a second lid hinge pivot axis, which extends parallel to the first lid hinge pivot axis, of the second lid hinge from a second basic setting not intended for eating into a second handling setting, wherein the second handling part in its first handling setting and the third handling part in its second handling setting form together with the first handling part a handle for manual operation of the eating utensil part, which is folded out into its eating use setting, for eating a content of the container, and wherein the third handling part comprises a second eating utensil engagement-over support body which in the second handling setting of the third handling part is opposite the eating utensil part in the eating use setting on the second eating utensil side, which faces away from the first eating utensil side, of the eating utensil part so that for acceptance of use forces acting in a third force direction opposite to the first force direction the eating utensil part is directly or indirectly supportable or supported on the second eating utensil engagement-over support body. As a result, a more complete and stable handle capable of simple handling can be achieved from the lid after folding out the eating utensil part into the eating use setting, by way of which handle the folded-out eating utensil part can be loaded in all directions for eating or removal of a container content without folding in or folding back of the eating utensil part occurring. A lid of that kind can be produced comparatively simply and economically. Manipulation of the lid for forming the handle by the folded-out eating utensil part as well as manipulation of the eating utensil produced from the lid are particularly simple.

According to a preferred development it can be provided that the second handling part and the third handling part each have an outer profile formed symmetrically with respect to a center longitudinal axis of the first handling part or symmetrically with respect to the eating utensil part longitudinal axis. Production and handling can thereby be further improved.

It will be obvious that the lid can have almost any desired shape. In particular, the lid can have a circular or circularly round outer edge, a rectangle-shaped or rectangular outer edge, a four-corner-shaped or four-cornered outer edge or an oval outer edge.

According to a preferred development it can be provided that the second lid hinge extends with interruption or without interruption continuously between a third outer edge part of the lid outer edge and a fourth outer edge part, which faces away from the third outer edge part, of the lid outer edge. An even greater stability or stiffness and an even greater functional reliability can thereby be achieved.

According to an embodiment it can be provided that the second lid hinge or the second lid hinge pivot axis extends parallel to the eating utensil part longitudinal axis or parallel to a center longitudinal axis of the first handling part. Further improved handling and functional reliability can thereby be achieved.

According to an advantageous development it can be provided that the second lid hinge is a second lid film hinge. An even greater degree of functionality and functional reliability together with even simpler and more economic capability of production can thereby be achieved.

According to a preferred embodiment it can be provided that the first handling part and/or the second handling part and/or the third handling part is or are provided with abutments which on folding-over of the second handling part relative to the first handling part about the first lid hinge and on folding-over of the third handling part relative to the first handling part about the second lid enable abutment in each instance in an angular setting corresponding with an angle, preferably an angle of the same size, particularly 90 degrees. As a result a handle which is more stable in shape and advantageously with a better capability of handling is produced from the lid in simpler and more economic mode and manner.

According to an advantageous development it can be provided that the second handling part is provided with first securing means and the third handling part is provided with second securing means which is adapted thereto and at or in which the first securing means of the second handling part is securable, preferably securable to be detachable again, in order to secure the handling parts—which are folded together in the first and second handling settings to form the handle—against unintended folding back or at or in which the first securing means of the second handling part is secured, preferably securable to be detachable again, when the handling parts are folded together to form the handle so that the handling part is secured against unintended folding back.

In that case it can preferably be provided that the first securing means is detent means and that the second securing means is counter-detent means, at or in which the detent means is detentable with formation of a detent connection, particularly a snap connection, preferably to be releasable again, or at or in which the detent means is detented with formation of a detent connection, particularly a snap connection, preferably to be releasable again, when the handling parts are folded together to form the handle. Alternatively, it can be provided that the first securing means is a clamping means and that the second securing means is a counter-clamping means, at or in which the clamping means can be firmly clamped, preferably to be releasable again, with formation of a clamping connection or at or in which the clamping means is firmly clamped, preferably to be releasable again, with formation of a clamping connection when the handling parts are folded together to form the handle. This makes possible particularly simple handling and functional reliability.

According to a preferred variant of embodiment it can be provided that the lid has a container engagement-over edge, which is partly or completely encircling and which extends in a direction transversely or perpendicularly to an inner cover surface of the lid body out beyond the inner cover surface, for engagement over a container edge of a container to be covered or closed by means of the lid. A lid constructed in that manner can be used particularly advantageously as a closure for a container, which closure has a matching opening geometry of the container opening to be covered and closed. The lid can preferably be constructed as a closure lid. The container engagement-over edge can be provided with one or more closure means for releasable closing of a container.

According to a particularly preferred embodiment it can be provided that the container engagement-over edge has a first container engagement-over edge part associated with the second handling part and a second container engagement-over edge part associated with the third handling part, and wherein the first eating utensil engagement-over support body of the second handling part is a component of the first container engagement-over edge part and wherein the second eating utensil engagement-over support body of the third handling part is a component of the second container engagement-over edge part and wherein the container engagement-over edge has a third container engagement-over edge part associated with the second handling part and a fourth container engagement-over edge part associated with the third handling part, particularly wherein the third container engagement-over edge part is preferably approximately opposite the first container engagement-over edge part and the fourth container engagement-over edge part is preferably approximately opposite the second container engagement-over edge part, and wherein the third container engagement-over edge part has a first edge part which in the first handling setting is opposite a body part, particularly edge part, of the first handling part and wherein the fourth container engagement-over edge part has a second edge part which in the second handling setting is opposite the body part of the first handling part. Even greater stability or stiffness can thereby be achieved together with easier handling.

In that case according to a particularly preferred embodiment it can be provided that a fifth container engagement-over edge part, which can also be called first opening flap, of the container engagement-over edge and the first handling part are integrally connected, preferably with the same material, by way of a first engagement-over edge hinge, particularly formed as a film hinge, arranged in the region of the first eating utensil part engagement-over support body, and that the fifth container engagement-over edge part, preferably in the region of its lower edge, and the first container engagement-over edge part, preferably in the region of its lower edge, are connected by way of a manually destructible first engagement-over edge frangible location and that the fifth container engagement-over edge part, preferably in the region of its lower edge, and the second container engagement-over edge part, preferably in the region of its lower edge, are connected by way of a manually destructible second engagement-over edge frangible location, and that a sixth container engagement-over edge part, which can also be called second opening flap, of the container engagement-over edge and the first handling part are integrally connected, preferably with the same material, by way of a second engagement-over edge hinge, particularly formed as a film hinge, arranged in the region of the body part, particularly edge part, of the first handling part and that the sixth container engagement-over edge part, preferably in the region of its lower edge, and the third container engagement-over edge part, preferably in the region of its lower edge, are connected by way of a manually destructible third engagement-over edge frangible location and that the sixth container engagement-over edge part, preferably in the region of its lower edge, and the fourth container engagement-over edge part, preferably in the region of its lower edge, are connected by way of manually destructible fourth engagement-over edge frangible location, so that after destruction, preferably manual destruction, of the first engagement-over edge frangible location and the second engagement-over edge frangible location the fifth container engagement-over edge part is foldable away outwardly or inwardly about a first engagement-over edge hinge pivot axis of the first engagement-over edge hinge and after destruction, preferably manual destruction, of the third engagement-over edge frangible location and the fourth engagement-over edge frangible location the sixth container engagement-over edge part is foldable away outwardly or inwardly about a second engagement-over edge hinge pivot axis of the second engagement-over edge hinge, so that the second handling part is foldable about the first lid hinge pivot axis of the first lid hinge and the third handling part about the second lid hinge pivot axis of the second lid hinge relative to one another to form the handle. A handling capability which is particularly simple and reliable and a particularly high level of functionality together with a particularly simpler and more economic capability of production are thereby achieved.

Alternatively, but less preferably, it can be provided that a fifth container engagement-over edge part, which can also be called first opening flap, and the second container engagement-over edge part are integrally connected together, preferably with the same material, by way of a first engagement-over edge hinge, which is preferably constructed as a film hinge, arranged in the region of the second eating utensil part engagement-over support body and preferably extending rectilinearly and that the fifth container engagement-over edge part, preferably in the region of its lower edge, and the first container engagement-over edge part, preferably in the region of its lower edge, are connected by way of a manually destructible first engagement-over edge frangible location arranged in the region of the first eating utensil part engagement-over support body, and that a sixth container engagement-over edge part, which is preferably opposite the fifth container engagement-over edge part and which can also called second opening flap, of the container engagement-over edge and the fourth container engagement-over edge part are integrally connected by way of a second container engagement-over edge hinge, which is arranged in the region of the body part, particularly edge part, of the first handling part, and that the sixth container engagement-over edge part, preferably in the region of its lower edge, and the third container engagement-over edge part, preferably in the region of its lower edge, are connected by way of a manually destructible second engagement-over edge frangible location so that after destruction of the first engagement-over edge frangible location the fifth container engagement-over edge part can be folded away outwardly or inwardly about a first engagement-over edge hinge pivot axis of the first engagement-over edge hinge and after destruction of the second engagement-over edge frangible location the sixth container engagement-over edge part can be folded away outwardly or inwardly about a second engagement-over edge hinge pivot axis of the second engagement-over edge hinge, so that the second handling part about the first lid hinge pivot axis of the first lid hinge and the third handling part about the second lid hinge pivot axis of the second lid hinge are foldable relative to one another to form the handle, or a fifth container engagement-over edge part, which can also be called opening flap, and the second container engagement-over edge part are integrally connected, preferably with the same material, by way of a first engagement-over edge hinge, particularly constructed as a film hinge, which is arranged in the region of the first eating utensil part engagement-over edge support body and which preferably extends rectilinearly, and that the fifth container engagement-over edge part, preferably in the region of its lower edge, and the second container engagement-over edge part, preferably in the region of its lower edge, are connected by way of a manually destructible first engagement-over edge frangible location arranged in the region of the second eating utensil engagement-over support body and that a sixth container engagement-over edge part, which is preferably opposite the fifth container engagement-over edge part and which can also be called second opening flap, of the container engagement-over edge and the third container engagement-over edge part are integrally connected by way of a second engagement-over edge hinge arranged in the region of the body part, particularly edge part, of the first handling part and that the sixth container engagement-over edge part, preferably in the region of its lower edge, and the fourth container engagement-over edge part, preferably in the region of its lower edge, are connected by way of a manually destructible second engagement-over edge frangible location so that after destruction of the first engagement-over edge frangible location the fifth container engagement-over edge part can be folded away outwardly or inwardly about a first engagement-over edge hinge pivot axis of the first engagement-over edge hinge and after destruction of the second engagement-over edge frangible location the sixth container engagement-over edge part can be folded away outwardly or inwardly about a second engagement-over edge hinge pivot axis of the second engagement-over edge hinge so that the second handling part about the first lid hinge pivot axis of the first lid hinge and the third handling part about the second lid hinge pivot axis of the second lid hinge are foldable relative to one another to form the handle. As a result, a comparatively simple and reliable capability of handling as well as a high functionality and functional reliability together with particularly simpler and more economic capability of production can still be achieved.

The invention also relates to an eating utensil which is produced directly from the lid according to the invention, particularly with one or more of the foregoing features, wherein the eating utensil part is folded out about the eating utensil part hinge pivot axis of the eating utensil part hinge into its eating use setting for eating a content of the container, in which the eating utensil part extends in the direction of its eating utensil part longitudinal axis transversely or perpendicularly away from the eating utensil part hinge pivot axis out beyond the lid outer edge of the handling body and in which the eating utensil part engagement-behind support body of the first handling part either is opposite, preferably at a small spacing, the eating utensil part on a first eating utensil part side of the eating utensil part so that for acceptance of use forces acting in the first force direction the eating utensil part is directly or indirectly supportable on the eating utensil part engagement-behind support body or bears directly or indirectly against the eating utensil part on a first eating utensil part side of the eating utensil part so that for acceptance of use forces acting in the first force direction the eating utensil part is directly or indirectly supported on the eating utensil part engagement-behind support body, and wherein the first handling part and the second handling part in their first handling setting are folded about the first lid hinge pivot axis of the first lid hinge, in which the first handling part and the second handling part form a handle for manual operation of the eating utensil part, which is folded out into its eating use setting, for eating a content of the container and in which the first eating utensil part engagement-over support body of the second handling part either is opposite, preferably at a small spacing, the eating utensil part on a second eating utensil part side, which faces away from the first eating utensil part side, of the eating utensil part so that for acceptance of use forces acting in the second force direction opposite to the first force direction the eating utensil part is directly or indirectly supportable on the first eating utensil part engagement-over support body or bears directly or indirectly against the eating utensil part on a second eating utensil part side, which faces away from the first eating utensil part side, of the eating utensil part so that for acceptance of use forces acting in the second force direction opposite to the first force direction the eating utensil part is directly or indirectly supported on the eating utensil part engagement-over support body and in which the handling parts are secured by way of the at least one securing means against unintended folding back. The advantages mentioned in the introduction are achieved to a particular degree with an eating utensil produced or constructed in that way.

The invention also relates to an eating utensil which is produced directly from the lid according to the invention, particularly with one or more of the foregoing features, wherein the eating utensil part is folded out about the eating utensil part hinge pivot axis of the eating utensil part hinge into its eating use setting for eating a content of the container, in which the eating utensil part extends in the direction of its eating utensil part longitudinal axis transversely or perpendicularly away from the eating utensil part hinge pivot axis out beyond the lid outer edge of the handling body and in which the eating utensil part engagement-behind support body of the first handling part either is opposite, preferably at a small spacing, the eating utensil part on a first eating utensil part side of the eating utensil part so that for acceptance of use forces acting in the first force direction the eating utensil part is directly or indirectly supportable, preferably by way of a first opening flap, on the eating utensil part engagement-behind support body or bears directly or indirectly, preferably by way of a first opening flap, against the eating utensil part on a first eating utensil part side of the eating utensil part so that for acceptance of use forces acting in the first force direction the eating utensil part is directly or indirectly supported on the eating utensil part engagement-behind support body, and wherein the second handling part is disposed in its first handling setting folded about the first lid hinge pivot axis of the first lid hinge and the third handling part is disposed in its second handling setting folded about the second lid hinge pivot axis of the second lid hinge, in which handling settings the second handling part, the first handling part and the third handling part form a handle for manual operation of the eating utensil part, which is folded out into its eating use setting, for eating a content of the container, and in which handling settings the first eating utensil part engagement-over support body of the second handling part either is opposite, preferably at a small spacing, the eating utensil part on a second eating utensil part side, which faces away from the first eating utensil part side, of the eating utensil part so that for acceptance of use forces acting in the second force direction opposite to the first force direction the eating utensil part is directly or indirectly supportable on the first eating utensil part engagement-over support body or bears directly or indirectly against the eating utensil part on a second eating utensil part side, which faces away from the first eating utensil part side, of the eating utensil part so that for acceptance of use forces acting in the second force direction opposite to the first force direction the eating utensil part is directly or indirectly supported on the eating utensil part engagement-over support body, and in which handling settings the second eating utensil part engagement-over support body of the third handling part either is opposite, preferably at a small spacing, the eating utensil part on the second eating utensil part side, which faces away from the first eating utensil part side, of the eating utensil part so that for acceptance of use forces acting in the third force direction opposite to the first force direction the eating utensil part is directly or indirectly supportable on the second eating utensil part engagement-over support body or bears directly or indirectly against the eating utensil part on the second eating utensil part side which faces away from the first eating utensil part side, of the eating utensil part so that for acceptance of use forces acting in the third force direction opposite to the first force direction the eating utensil part is directly or indirectly supported on the eating utensil part engagement-over support body and in which handling settings the handling parts are secured by way of the at least one securing means against unintended folding back. The advantages mentioned in the introduction can be achieved to particular extent also with an eating utensil produced or constructed in that way, wherein in addition the advantages evident from the following description part are achievable. An eating utensil of that kind can be produced particularly advantageously from a closure lid according to the invention. In this case, there is the advantageous possibility of converting the eating utensil back into a closure lid so as to again close a matching container opening of a container closed by the original closure lid, for example in order to avoid entry of insects.

According to a particularly preferred embodiment it can be provided that the support pin extends by its pin part through the eating utensil part passage of the eating utensil part so that the eating utensil part is either supportable on the pin by way of the passage edges of its eating utensil part passage or is supported on the support pin by way of the passage edges of its eating utensil part passage. The eating utensil part can thereby be supported against lateral use forces and use moments even better than is possible solely due the eating utensil hinge.

According to an advantageous development it can be provided that the first eating utensil engagement-over support body and the second eating utensil engagement-over support body in the respective basic setting of the first and second handling bodies extend rectilinearly and parallel to one another or are bounded by edge wall parts extending rectilinearly and parallel to one another. Advantageous supporting and stability conditions can thereby be achieved.

It will be apparent from the description herein that the foregoing features can be combined as desired within the scope of feasibility.

BRIEF DESCRIPTION OF THE DRAWINGS

Other objects and features of the invention will become apparent from the following detailed description considered in connection with the accompanying drawings. It is to be understood, however, that the drawings are designed as an illustration only and not as a definition of the limits of the invention.

In the drawings.

DETAILED DESCRIPTION OF PREFERRED EMBODIMENTS

Figure 1:
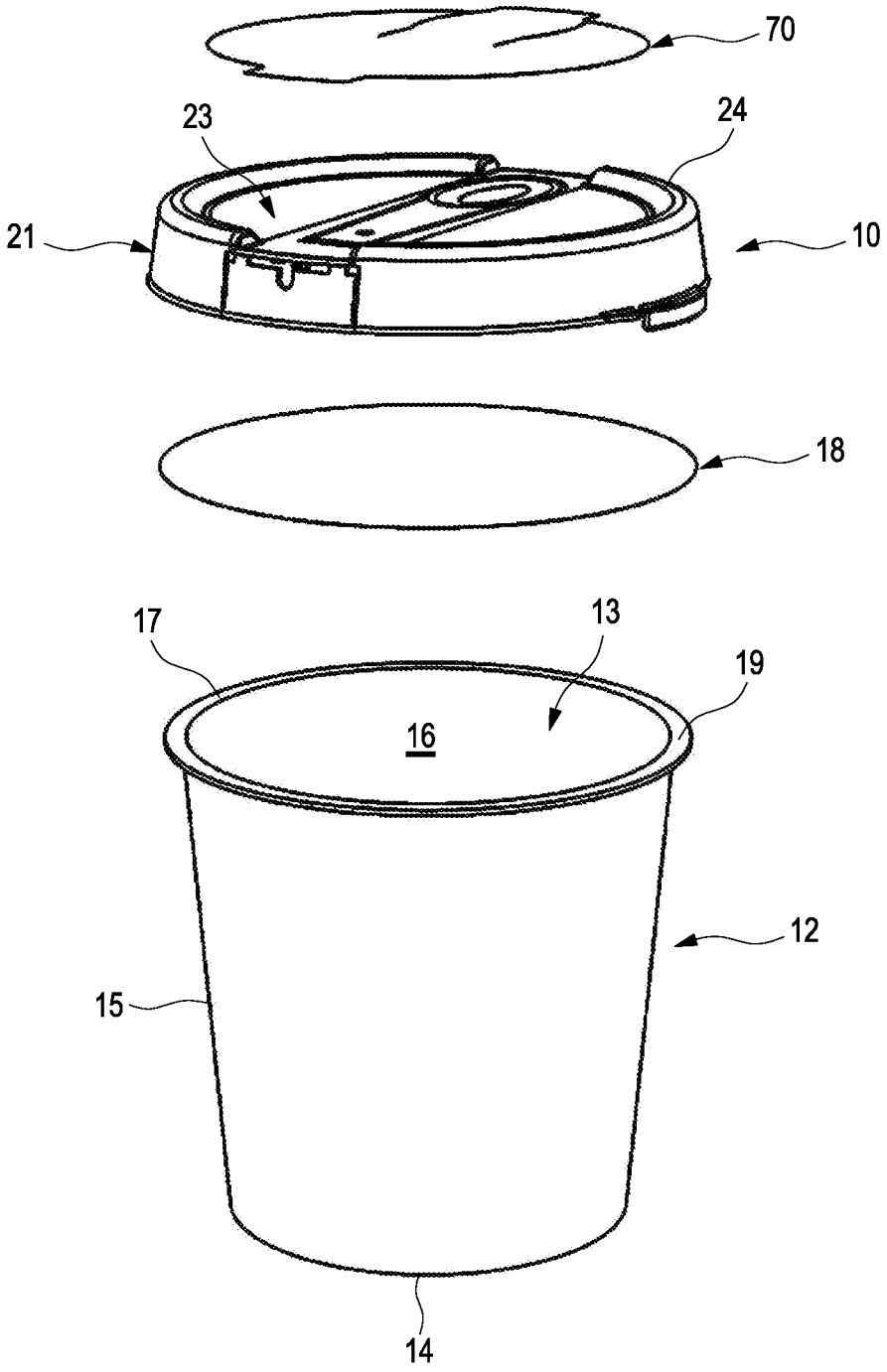
FIG. 1 shows a perspective exploded illustration of an arrangement comprising a container, an optional sealing membrane, a lid for the container and a cover foil of the lid.
Figure 2:
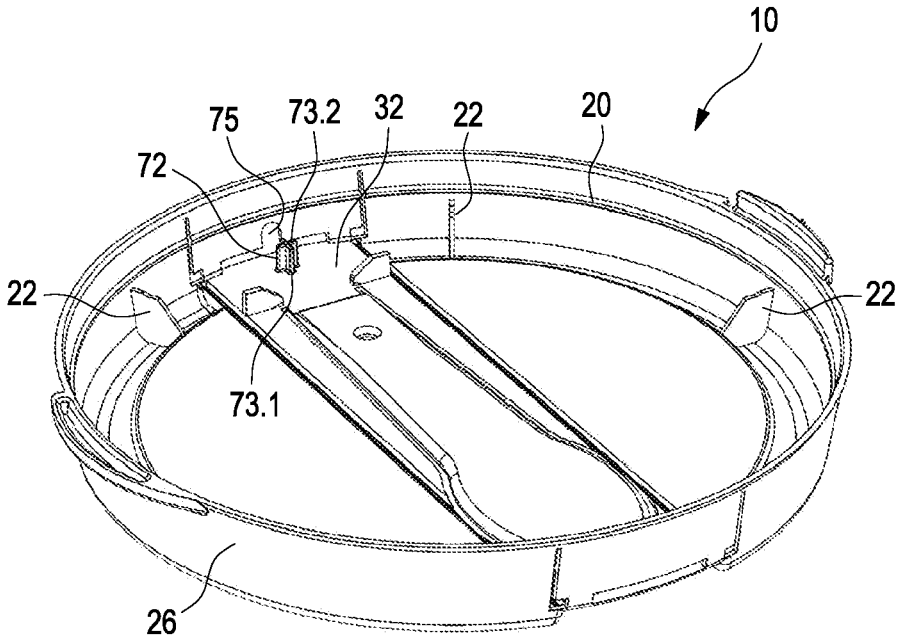
FIG. 2 shows a first underneath view of the lid provided with the cover foil, in a perspective illustration.
Figure 3:
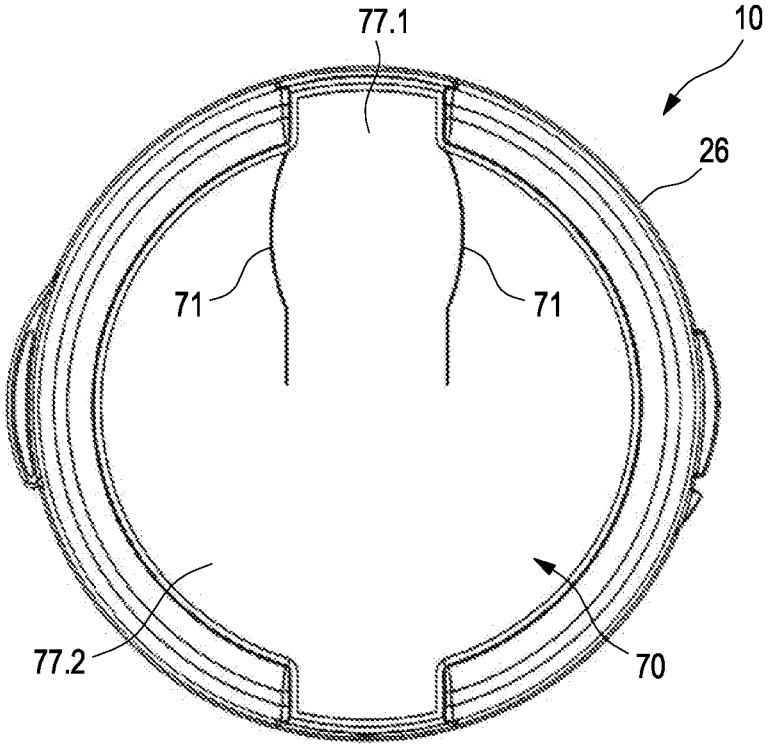
FIG. 3 shows a top view of the lid provided with the cover foil, in a two-dimensional illustration.
Figure 4:
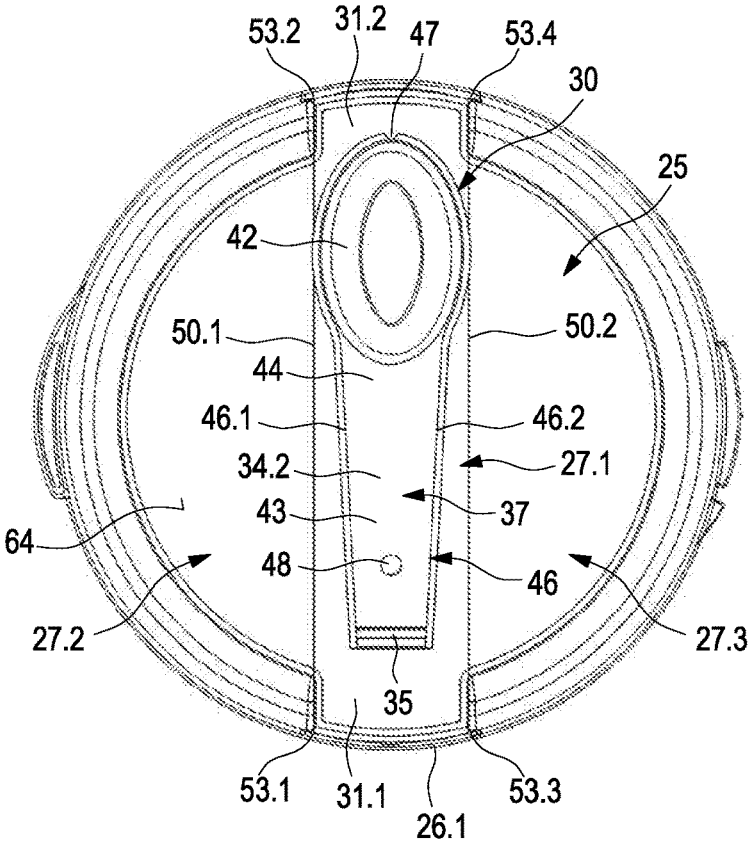
FIG. 4 shows a top view of the lid without the cover foil, in a two-dimensional illustration.
Figure 5:
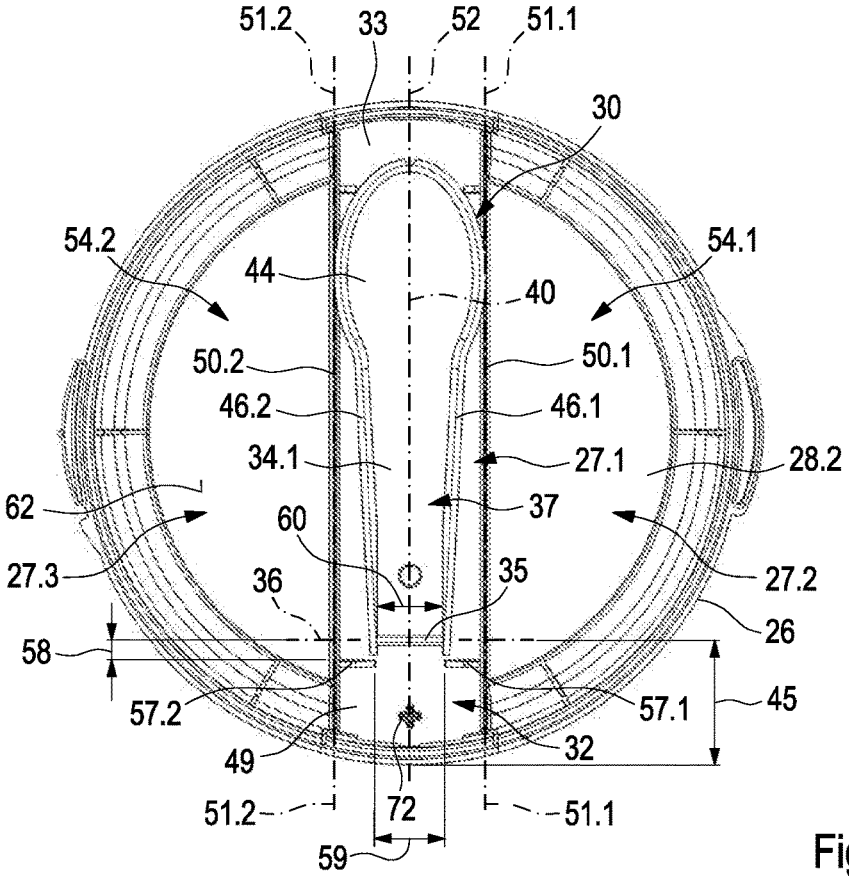
FIG. 5 shows an underneath view of the lid provided with the cover foil in a two-dimensional illustration.
Figure 10:
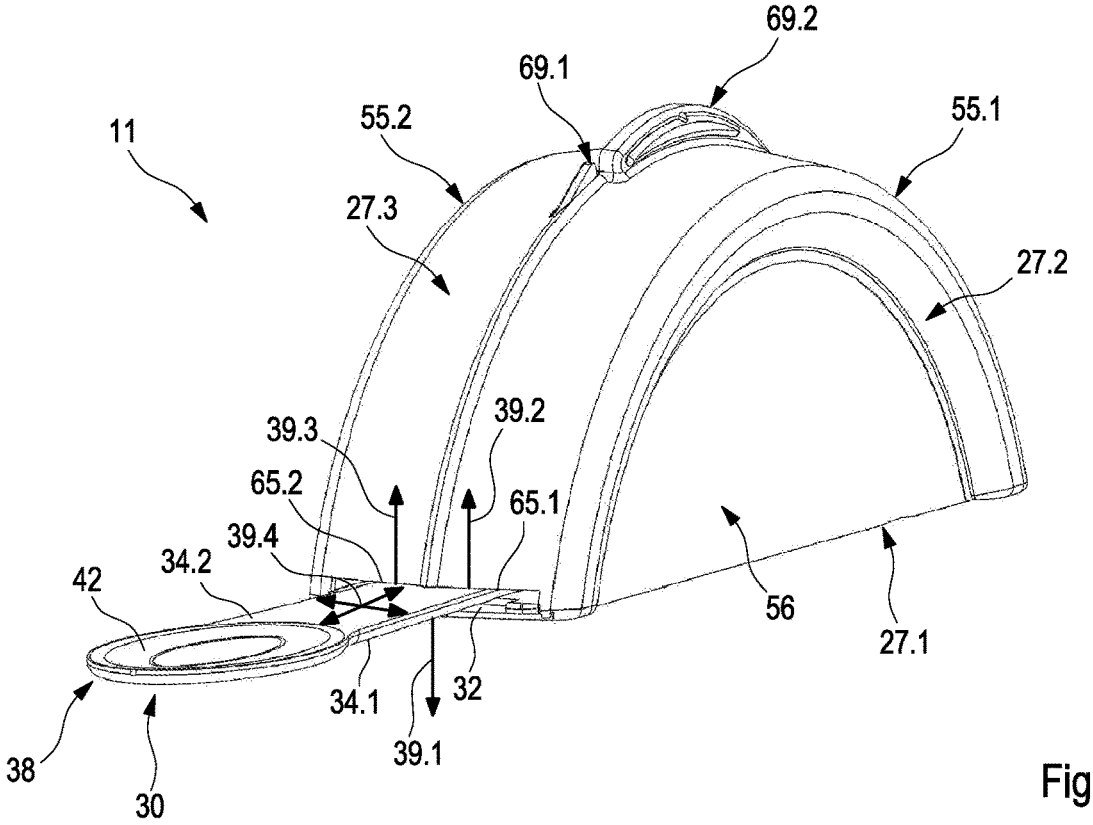
FIG. 10 shows an eating utensil produced directly from the lid provided with the cover foil, in a perspective illustration.
Figure 11:
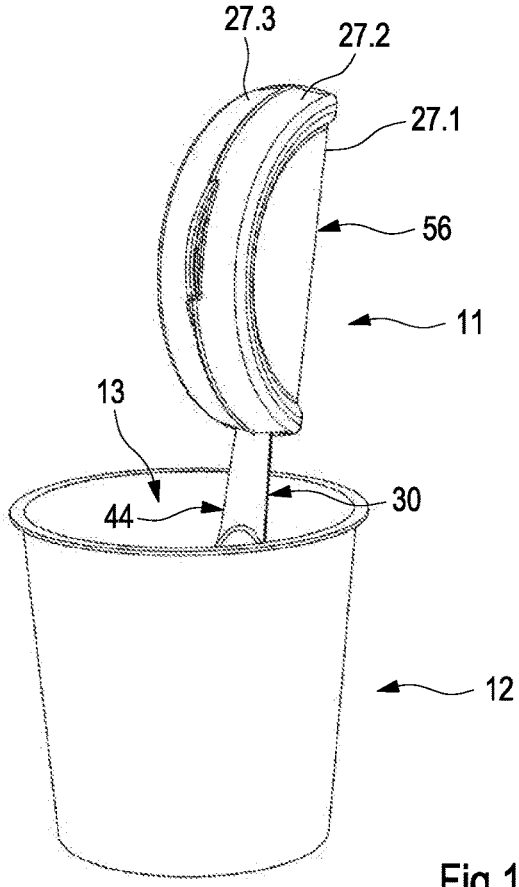
FIG. 11 shows the container according to FIG. 1 and the eating utensil according to FIG. 10, which is introduced by its eating utensil part through a container opening into a container cavity of the container.

A preferred embodiment of a lid 10 according to the invention is shown in FIGS. 1 to 5 and 8. This lid 10 is a closure lid. An eating utensil 11 directly produced from the closure lid 10 is shown in FIGS. 10 and 11. For the sake of clarification, the closure lid 10 is shown in FIGS. 1 and 11 together with a portable container 12. For further clarification, the eating utensil 11 produced directly from the closure lid 10 is similarly shown together with the container 12.

A container content (not shown in the figures), for example a foodstuff such as soft cheese or ice-cream, can be stored in the container 12. The container 12 is a packaging container. The container 12 has a circular container opening 13, a circular container base 14 and a conical container circumferential wall 15. The container circumferential wall 15 bounds, together with the container base 14, a container cavity 16. The container opening 13 is bounded by an encircling rim 17. In order to protect the container content from contaminants, the container opening 13 can be tightly closed by means of the sealing membrane 18, which is shown in FIG. 1, to be manually openable. The container 12 without a sealing membrane or provided with a sealing membrane 18 of that kind can be closed or is able to be (re)closed by means of the closure lid 10 according to the invention (see FIG. 6).

Figure 6:
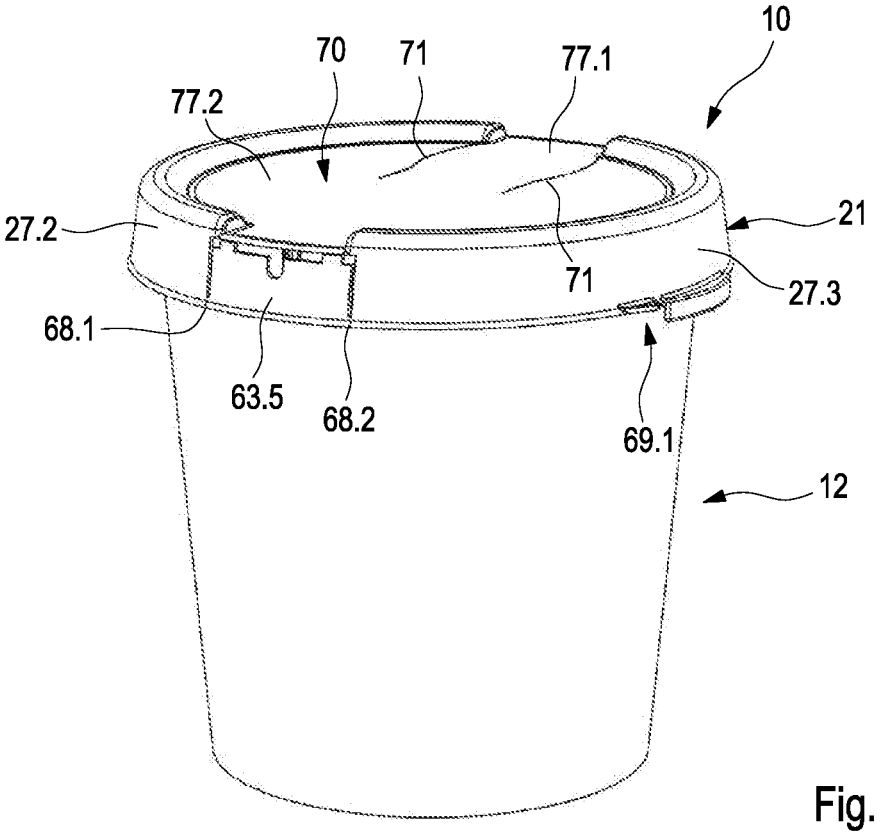
FIG. 6 shows the lid provided with the cover foil and the container closed by that, in a perspective illustration.
Figure 7:
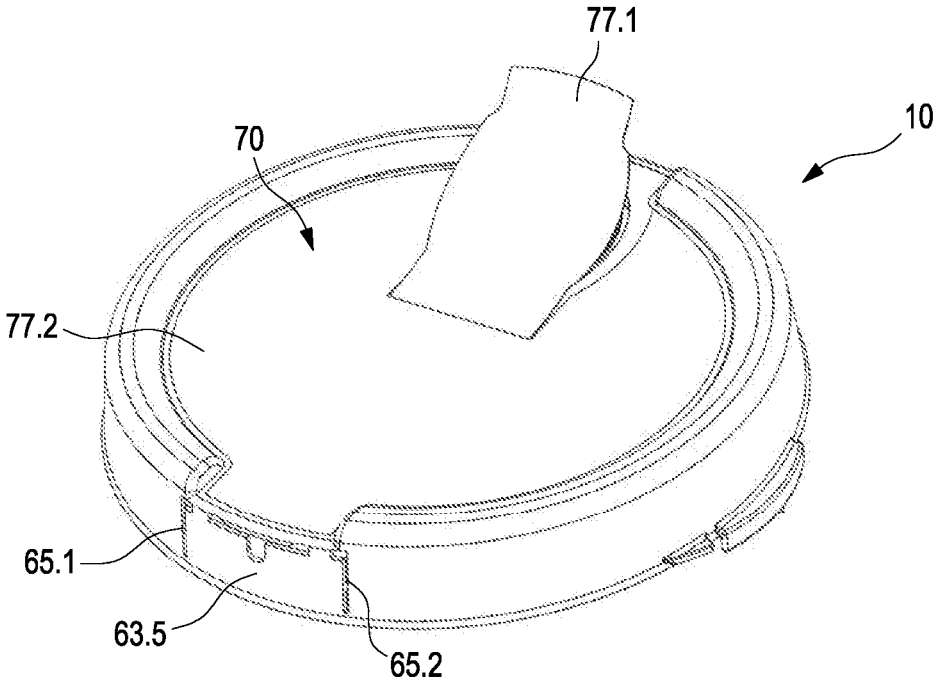
FIG. 7 shows a top view of the lid with partly detached cover foil, in a perspective illustration.
Figure 8:
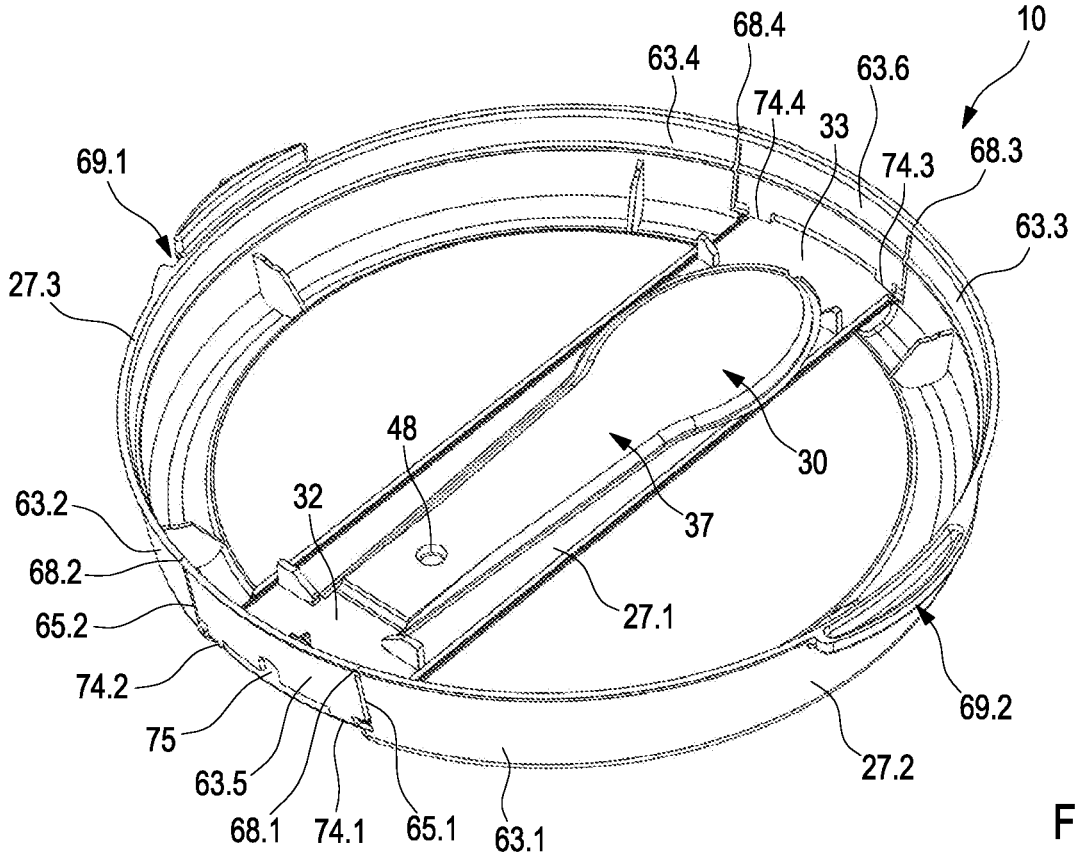
FIG. 8 shows a second underneath view of the lid provided with the cover foil, in a perspective illustration.

The closure lid 10 is intended for covering and closing the container 12 shown in FIGS. 1, 6 and 11. For that purpose the closure lid 10 has a container engagement-over edge 21 with an inwardly disposed closure means 20 in the form of an inwardly projecting, encircling inner edge for manually releasable closure of the container 12 by detenting behind the container edge 19. The closure lid 10 has a plurality of spacers 22 in the form of spacer ribs for supporting the closure lid 10 on the container edge 19 or on the optional sealing membrane 18 and also for stacking several identical closure lids 10 one above the other. The closure lid 10 comprises a lid body 23, which is bounded by a lid edge 24. The closure lid 10 is designed to be matched to the shape of the rim 17 of the container 12. In the illustrated embodiment the rim 17 of the container 12 and the lid outer edge 26 each have a shape formed to be substantially circular. However, it will be obvious that the container rim and the lid edge can also have other shapes matched to one another.

The lid body 23 of the closure lid 10 comprises a handling body 25, which is bounded by a lid outer edge 26. The handling body 25 comprises a plurality of handling parts 27.1, 27.2, 27.3 and, specifically, a first handling part 27.1, a second handling part 27.2 and a third handling part 27.3. The first handling part 27.1 forms a middle part of the closure lid 10. The second handling part 27.2 forms a first closure half of the closure lid 10 and the third handling part 27.3 forms a second closure half of the closure lid.

Figure 9:
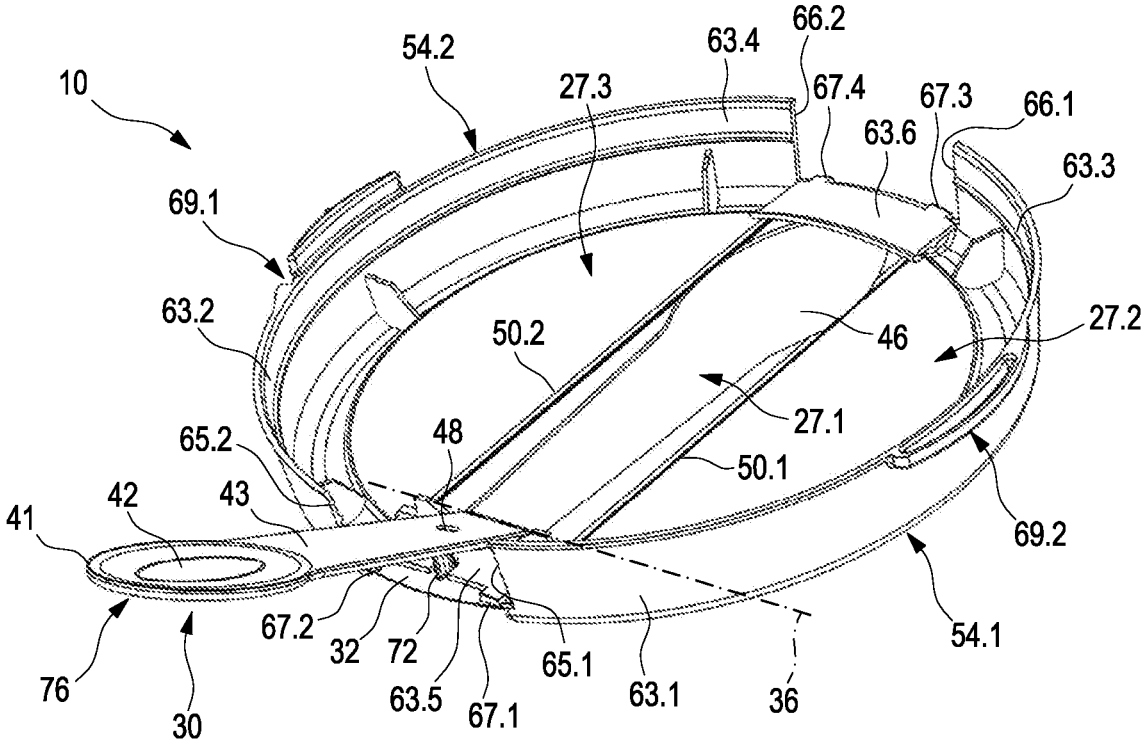
FIG. 9 shows a third underneath view of the lid provided with the cover foil, in a perspective illustration, wherein two opening flaps of the container engagement-over edge of the lid are folded inwardly and wherein the eating utensil part is folded outwardly into an intermediate setting.

The first handling part 27.1 formed as middle part comprises an integrated eating utensil part 30, a first eating utensil part engagement-behind support body 32 at its first handling part end 31.1, and a body part 33, which is constructed as an edge part, at its second handling part end 31.2 extending away from the first handling part end 31.1 in an opposite direction. The eating utensil part 30 and the eating utensil part engagement-behind support body 32 are non-detachably integrally connected together, preferably of the same material, by way of a rectilinearly extending eating utensil part hinge 35 in such a way that the eating utensil part 30 is pivotable or foldable out relative to the first handling body or middle part 27.1 about an eating utensil part hinge pivot axis 36 of the eating utensil part hinge 35 from a not-folded-out, non-use setting 37, which is shown in FIGS. 1 to 8 and which is not intended for eating, via an intermediate pivot setting 76, which is shown in FIG. 9, through approximately 180 degrees into an eating use setting 38, which is shown in FIGS. 10 and 11. In the eating use setting 38 the eating utensil part engagement-behind support body 32 of the first handling part or middle part 27.1 is opposite the eating utensil part 40 on a first eating utensil part side 34.1 of the eating utensil part 30. As a result, the eating utensil part 30 in the eating use setting 38 is indirectly supportable or supported on the eating utensil part engagement-behind support body 32, preferably by way of the fifth container engagement-over edge part 63.5 also termed first opening flap, for acceptance of use forces acting in a first force direction 39.1 (see FIG. 10). The eating utensil part 30 extends in a longitudinal direction along its eating utensil part longitudinal axis 40. The eating utensil part hinge 35 is formed as a film hinge.

The eating utensil part 30 has an eating functional part 42 at its free eating utensil part end 41 facing away from the eating utensil part hinge 35. In the illustrated embodiment the eating functional part 42 is a spoon basin, which is also termed bowl. A spoon stem part 43 is formed between the spoon basin 42 and the eating utensil part hinge 35. The eating utensil part 30 is thus, for example, a spoon part of a spoon 44. The eating utensil part hinge 35 as considered in a direction perpendicular to the eating utensil part hinge 35 is arranged at a hinge spacing 45 from the lid outer edge 26.1 of a first handling part or middle part 27.1 of the handling body 25. The eating utensil part engagement-behind support body 32 of the first handling part or middle part 27.1 is arranged between this lid outer edge 26.1 and the eating utensil part hinge 35.

In the non-use setting 37 the eating utensil part 30 extends perpendicularly away from the eating utensil part hinge 35 parallel to its eating utensil part longitudinal axis 40. In the eating use setting 38 the eating utensil part 30 extends perpendicularly away from the eating utensil part hinge 35 in the direction of its eating utensil part longitudinal axis 40 out beyond the lid outer edge 26; 26.1. In its non-use setting 37 the eating utensil part 30 is completely surrounded by the lid outer edge 26 of the handling body 25. The first handling part or middle part 27.1 is constructed as an eating utensil part receiving part with an eating utensil part receiving passage 46; 46.1, 46.2, which is here formed with a first eating utensil part receiving passage 46.1 and a second eating utensil part receiving passage 46.2. The eating utensil part 30, which is pivotably connected by way of the eating utensil part hinge 35 with the eating utensil part engagement-behind support body 32, in its non-use setting 37 is received in the eating utensil part receiving passage. In the non-use setting 37 of the eating utensil part 30 the body part 33 of the first handling part or middle part 27.1 is opposite the spoon basin 42. The eating utensil part 30 is provided, preferably at least in the region of its eating functional part 42, particularly at the free end 41 of the eating functional part 42 or of the eating utensil part 30, with at least one manually detachable or manually destructible fixing means 47, for example in the form of a connection, for fixing the eating utensil part 30 against unintended folding out from the eating utensil part receiving passage 46; 46.1, 46.2. The at least one fixing means 47 can also be a means for repeat fixing of the eating utensil part 30 against unintended folding out from the at least one eating utensil part receiving passage 46; 46.1, 46.2 after the eating utensil part 30 has been folded at least once about the eating utensil part hinge pivot axis 36 out from the eating utensil part receiving passage 46; 46.1, 46.2. If, as in the illustrated embodiment, the fixing means 47 is provided, then if the eating utensil part 30 is in its non-use setting 37 the eating utensil part receiving passage 46 is divided by the fixing means 47 into the two eating utensil part receiving passages 46.1, 46.2. The two eating utensil part receiving passages 46.1, 46.2 then each form a gap.

A support pin 72 is fastened to the eating utensil part engagement-behind support body 32 of the first handling part 27.1. The support pin 72 extends from its first pin end 73.1 perpendicularly away from an inner surface 49 of the eating utensil part engagement-behind support body 32 to its second, free pin end 73.2. The eating utensil part 30 has an eating utensil part passage 48 for reception of a pin part of the support pin 72. The eating utensil part passage 48 spans a passage cross-section, which is preferably circular. The passage cross-section is slightly smaller than a support pin cross-section which spans the support pin 72 and which the support pin 72 has in a pin region arranged between the first pin end 73.1 thereof and the second, free pin end 73.2.

The first handling part or middle part 27.1 comprising the eating utensil part 30 is bounded by two parallel lid hinges 50.1, 50.2 and, specifically, by a first lid hinge 50.1 and by a second lid hinge 50.2. These lid hinges 50.1, 50.2 and the lid hinge pivot axes 51.1, 51.2 thereof extend parallel to a center longitudinal axis 52 of the first handling part 27.1. In the non-use setting 37 and also in the eating use setting 38 of the eating utensil part 30 the two lid hinges 50.1, 50.2 and the lid hinge pivot axes 51.1, 51.2 thereof extend parallel to the eating utensil part longitudinal axis 40. The first lid hinge 50.1 is a first lid film hinge. The second lid hinge 50.2 is a second lid film hinge. The first lid hinge 50.1 and the second lid hinge 50.2 are of the same form. The two lid hinges 50.1, 50.2 and the lid hinge pivot axes 51.1, 51.2 thereof extend perpendicularly to the eating utensil part hinge 35 and perpendicularly to the eating utensil part hinge pivot axis 36 thereof. The first lid hinge 50.1 extends without interruption continuously between a first outer edge part 53.1 and a second outer edge part 53.2, which faces away from the first outer edge part 53.1, of the lid outer edge 26 or the container engagement-over edge 21. The second lid hinge 50.2 extends without interruption continuously between a third outer edge part 53.3 and a fourth outer edge part 53.4, which faces away from the third outer edge part 53.3, of the lid outer edge or the container engagement-over edge 21.

The second handling part 27.2, which is constructed as first closure half, and the first handling part 27.1, which is constructed as middle part, are integrally connected together, preferably with the same material, by way of the rectilinearly extending first lid hinge 50.1 in such a way that the second handling part 27.2 is foldable relative to the first handling part 27.1, which is constructed as middle part, about the first lid hinge pivot axis 51.1 of the first lid hinge 50.1 through a pivot angle of approximately 90 degrees from a first basic setting 54.1, which is not intended for eating and which is shown in FIGS. 1 to 9, into a first handling setting 55.1, which is shown in FIGS. 10 and 11. In the first handling setting 55.1 the handling parts 27.1, 27.2 form a handle 56 for manual operation of the eating utensil part 30, which is folded out into its eating use setting 38, for eating a content of the container 12.

The third handling part 27.3, which is constructed as second closure half, and the first handling part 27.1, which is constructed as middle part, are integrally connected together, preferably by the same material, by way of the rectilinearly extending second lid hinge 50.2 in such a way that the third handling part 27.3 is foldable relative to the first handling part 27.1, which is constructed as middle part, about the second lid hinge pivot axis 51.2 of the first lid hinge 50.1 similarly through a pivot angle of approximately 90 degrees from a second basic setting 54.2, which is not intended for eating and which is shown in FIGS. 1 to 9, into a second handling setting 55.2, which is shown in FIGS. 10 and 11. In the second handling setting 55.2 the handling parts 27.1, 27.3 form a handle 56 for manual operation of the eating utensil part 30 which is folded out into its eating use setting 38, for eating a content of the container 12.

The second handling part 27.2 and the third handling part 27.3 or the first closure half and the second closure half each have an outer profile formed symmetrically with respect to the center longitudinal axis 52 of the first handling part 27.1. This center longitudinal axis 52 extends parallel to the lid hinges 50.1, 50.2 or parallel to the lid hinge pivot axes 51.1, 51.2.

In order to limit the pivotation or folding-over of the second handling part or the first closure half 27.2 relative to the first handling part or middle part 27.1 about the first lid hinge pivot axis 51.1 of the first lid hinge 50.1 to the said first pivot angle of approximately 90 degrees and also to limit the pivotation or folding-over of the third handling part or the second closure half 27.3 relative to the first handling part or middle part 27.1 about the second lid hinge pivot axis 51.2 of the second lid hinge 50.2 to the said second pivot angle of approximately 90 degrees the first handling part or the middle part 27.1 is preferably provided with a plurality of support bodies 57.1, 57.2, which are also termed abutments. These can preferably be formed at the first eating utensil part engagement-behind support part 32 of the first handling part or middle part 27.1 and also at the opposite body part 33 of the first handling part or middle part 27.1. The support bodies or abutments 57.1, 57.2, which are formed at the eating utensil part engagement-behind support body 32, can preferably be constructed at the same time as eating utensil part support bodies for supporting the eating utensil part 30, which is folded out about the eating utensil part pivot axis 36 of the eating utensil part hinge 35 from its non-use setting 37 into its eating use setting 38, against lateral movements of the eating utensil part 30 and for acceptance of lateral use forces. For this purpose, a first eating utensil part support body 57.1 and a second eating utensil part support body 57.2, which as considered in a direction parallel to the eating utensil part hinge 35 are arranged at a transverse spacing 59 from one another, can thus be formed at the eating utensil part engagement-behind support body 38 to be arranged at a longitudinal spacing 58 from the eating utensil part hinge 35 as considered in a direction parallel to the lid hinges 50.1, 50.2 or to the lid hinge pivot axes 51.1, 51.2 thereof. This transverse spacing 59 is the same size as or slightly smaller than an eating utensil part width 60 which the eating utensil part 30 in the said longitudinal spacing 58 has from the eating utensil part hinge 35.

The closure lid 10 has a completely encircling container engagement-over edge 21 for engagement-over of a container edge 19 of the container 12 closable by means of the lid 10. The container engagement-over edge 21 extends in a direction transverse or perpendicular to an inner cover surface 62 of the lid body 23 out beyond the inner cover surface 62. The container engagement-over edge 21 has in the region of the eating utensil part engagement-behind support body 32 of the first handling part or middle part 27.1 a first container engagement-over edge part 63.1, which is associated with the second handling part or the first closure half 27.2. In addition, the container engagement-over edge 21 has in the region of the eating utensil part engagement-behind support body 32 of the first handling part or middle part 27.1 a second container engagement-over edge part 63.2, which is associated with the third handling part or the second closure half 27.2.

The first container engagement-over edge part 63.1 of the second handling part 27.2 has a first eating utensil part engagement-over support body 65.1. The first eating utensil part engagement-over support body 65.1 extends transversely to the first lid hinge 50.1 and transversely to the first lid hinge pivot axis 51.1. The first eating utensil part engagement-over support body 65.1 in the first handling setting 55.1, in which the second handling part 27.2 is pivoted relative to the first handling part 27.1 through an angle of approximately 90 degrees about the first lid hinge pivot axis 51.1 of the first lid hinge 50.1, and in the eating use setting 38 of the eating utensil part 30 is opposite the eating utensil part 30 of the first handling part or middle part 27.1 on a second eating utensil part side 34.2, which faces away from the first eating utensil part side 34.1, of the eating utensil part 30 so that the eating utensil part 30 is directly supportable or supported on the eating utensil part engagement-behind support body 32 for acceptance of use forces acting in a second force direction 39.2 against the first force direction 39.1 (see FIG. 10).

The second container engagement-over edge part 63.2 of the third handling part 27.3 has a second eating utensil part engagement-over support body 65.2. The second eating utensil part engagement-over support body 65.2 extends transversely to the second lid hinge 50.2 and transversely to the second lid hinge pivot axis 51.2. The second eating utensil part engagement-over support body 65.2 in the second handling setting 55.2, in which the third handling part 27.3 is pivoted relative to the first handling part 27.1 through an angle of approximately 90 degrees about the second lid hinge pivot axis 51.2 of the second lid hinge 50.2, and in the use setting 38 of the eating utensil part 30 is opposite the eating utensil part 30 of the first handling part or middle part 27.1 on the second eating utensil part side 34.2, which faces away from the first eating utensil part side 34.1, of the eating utensil part 30 so that the eating utensil part 30 is directly supportable or supported on the eating utensil part engagement-behind support body 32 for acceptance of use forces acting in a third force direction 39.3, which preferably extends parallel to the second force direction 39.2, opposite to the first force direction 39.1 (see FIG. 10).

The first eating utensil part engagement-over support body 65.1 is a component of the first container engagement-over edge part 63.1. The second eating utensil part engagement-over support body 65.2 is a component of the second container engagement-over edge part 63.2.

The container engagement-over edge 21 has a third container engagement-over edge part 63.3 associated with the second handling part 27.2 and a fourth container engagement-over edge part 63.4 associated with the third handling part 27.3. In the case of the second handling part 27.2, the third container engagement-over edge part 63.3 is approximately opposite the first container engagement-over edge part 63.1. In the case of the third handling part 27.3 the fourth container engagement-over edge part 63.4 is approximately opposite the second container engagement-over edge part 63.2. The third container engagement-over edge part 63.3 has a first edge part 66.1 which in the first handling setting 55.1 is opposite the body part 33 of the first handling part 27.1. The first edge part 66.1 extends transversely to the first lid hinge 50.1 and transversely to the first lid hinge pivot axis 51.1 thereof. The fourth container engagement-over edge part 63.4 has a second edge part 66.2 which in the second handling setting 55.2 is similarly opposite the body part 33 of the first handling part 27.1. The second edge part 66.2 extends transversely to the second lid hinge 50.2 and transversely to the second lid hinge pivot axis 51.2 thereof. The body part 33, which is constructed as an edge part, of the first handling part 27.1 is opposite the eating utensil part engagement-behind support body 32 as considered in a direction parallel to the lid hinges 50.1, 50.2 and parallel to the lid hinge pivot axes 51.1, 51.2 thereof or is opposite the eating utensil part engagement-behind support body 32 as considered in a direction perpendicular to the eating utensil part hinge 35 and perpendicular to the eating utensil part hinge pivot axis 36.

A fifth container engagement-over edge part 63.5, which is also termed first opening flap, of the container engagement-over edge 61 and the first handling part 37.1 are integrally connected by way of two engagement-over edge hinges 67.1, 67.2 arranged in the region of the first eating utensil part engagement-over support body 65.1. The engagement-over edge hinges 67.1, 67.2 are film hinges. A first engagement-over edge hinge 67.1 of the two engagement-over edge hinges 67.1, 67.2 and a second engagement-over edge hinge 67.2 of the engagement-over hinges 67.1, 67.2 are arranged opposite one another at a first transverse spacing.

The fifth container engagement-over edge part or the first opening flap 63.5 and the first container engagement-over edge part 63.1 are respectively connected together in the region of the lower edge thereof by way of a manually destructible first engagement-over edge frangible location 68.1. The fifth container engagement-over edge part or the first opening flap 63.5 and the second container engagement-over edge part 63.2 are respectively connected together in the region of the lower edge thereof by way of a manually destructible second engagement-over edge frangible location 68.2.

A sixth container engagement-over edge part 63.6, which is also termed second opening flap, of the container engagement-over edge 61 and the first handling part 27.1 are integrally connected together by way of two engagement-over edge hinges 67.3, 67.4 arranged in the region of the body part 33, which forms an edge part and is opposite the eating utensil part engagement-behind support body 32, of the first handling part 27.1. The engagement-over edge hinges 67.3, 67.4 are film hinges. A third engagement-over edge hinge 67.3 of the engagement-over edge hinges 67.1, 67.2 and a fourth engagement-over edge hinge 67.4 of the engagement-over edge hinges 67.3, 67.4 are arranged at a second transverse spacing from one another. The second transverse spacing is preferably the same size as the first transverse spacing.

The sixth container engagement-over edge part or the second opening flap 63.6 and the third container engagement-over edge part 63.3 are respectively connected in the region of the lower edge thereof by way of a manually destructible third engagement-over edge frangible location 68.3. The sixth container engagement-over edge part or the second opening flap 63.6 and the fourth container engagement-over edge part 63.4 are respectively connected in the region of the lower edge thereof by way of a manually destructible fourth engagement-over edge frangible location 68.4.

After—preferably manual—destruction of the first engagement-over edge frangible location 68.1 and after—preferably manual—destruction also of the second engagement-over edge frangible location 68.2 the fifth container engagement-over edge part or the first opening flap 63.5 is foldable away about a first engagement-over edge hinge pivot axis 74.1 of the first engagement-over edge hinge 67.1 and about a second engagement-over edge hinge pivot axis 74.2 of the second engagement-over edge hinge 67.2 inwardly in direction towards the eating utensil part engagement-behind support body 32 (see FIG. 9).

After—preferably manual—destruction of the third engagement-over edge frangible location 68.3 and after—preferably manual—destruction also of the fourth engagement-over edge frangible location 68.4 the sixth container engagement-over edge part or the second opening flap 63.6 is foldable away about a third engagement-over edge hinge pivot axis 74.3 of the third engagement-over edge hinge 67.3 and about a fourth engagement-over edge hinge pivot axis 74.4 of the fourth engagement-over edge hinge 67.4 inwardly in direction towards the edge part or body part 33 of the first handling part 27.1 (see FIG. 9). The second handling part 27.2 can be subsequently folded about the first lid hinge pivot axis 51.1 of the first lid hinge 50.1, and the third handling part 27.3 about the second lid hinge pivot axis 51.2 of the second lid hinge 50.2, relative to one another and together to form the handle 56. In that case, a securing connection, which is preferably releasable again, can be created by manually plugging together the first and second securing means 69.1, 69.2. The first securing means 69.1 can be a clamping means, for example male clamping means, and the second securing means 69.2 can be a counter-clamping means, for example female counter-clamping means, in or at which the clamping means is fixedly clamped, preferably to be releasable again, with formation of a clamping connection when the handling parts 27.1, 27.2, 27.3 are folded together to form the handle 56, as shown in FIGS. 10 and 11.

The lid body 23 of the closure lid 10 consists of an intrinsically stiff material. In the embodiment, the lid body 23 consists of a thermoplastic plastics material, preferably polypropylene. The lid body 23 is preferably produced in an injection-molding method.

The cover foil 70 applied over the upper outer surface 64 of the lid body 23 covers the first handling part or the middle part 27.1 and consequently also covers the eating utensil receiving passage 46; 46.1, 46.2 of the first handling part or middle part 27.1. The cover foil 70 also covers an upper outer surface of the second handling part or the first closure half 27.2 as well as an upper outer surface of the third handling part or the second closure half 27.3. The eating utensil part 30 is covered on its second eating utensil part side 34.2 in sterile manner relative to the environment by means of the cover foil 70 (see FIG. 3). The cover foil 70 is connected at least partly by way of a non-detachable connection with at least the second handling part 27.2 and the third handling part 27.3. By contrast thereto, the cover foil 70 adheres to at least the eating utensil part 30 on the second eating utensil part side 34.2 thereof, preferably to the entire or substantially entire first handling part 27.1, to be able to be manually detached or pulled off. For easy and defined pulling-off of the cover foil 70, this is provided with perforations 71 forming frangible locations. These are formed along the two lid hinges 50.1, 50.2 (see FIG. 3). The non-detachable connection of the cover foil 70 with the lid body 23 is effected in one working process with the production of the lid body 23 in a so-called in-mold method. The cover foil 70 and the lid body 23 are produced in a single-stage working process. This is also called in-mold labelling (IML) or IML method. After pulling a first foil part 77.1 of the cover foil 70 off the eating utensil part 30 the pulled-off first foil part 77.1 remains fixedly connected with the lid body 23 due to the non-detachable connection of the remaining second foil part 77.2 (see FIG. 7). The environment is thereby safeguarded. The cover foil 70 and the lid body 23 consist of the same material or of a mono-material, thus preferably polypropylene. This enables category-pure recycling of the closure lid 10.

In order to produce the eating utensil 11, which is shown in FIGS. 10 and 11, from the closure lid 10 the procedure can be as follows:

If the closure lid 10, as shown in FIG. 6, is fastened to the container 12 it can be manually detached from the container. The closure lid 10 is then free for handling.

Starting from the closure lid able to be freely handled, the cover foil 70, at least the first foil part 77.1 covering the eating utensil part 30, can be manually pulled off the eating utensil part 30 along the perforations 71 forming the frangible locations. The pulled-off first foil part 77.1 is then still fixedly connected with the remaining second foil part 77.2 of the cover foil 70, which is fixedly connected with the second and third handling parts 27.2, 27.3 by way of the non-detachable connection.

Subsequently, or even beforehand, the first opening flap, thus the fifth container engagement-over edge part 63.5, of the closure lid 10 is manually detached. For this purpose the first engagement-over edge frangible location 68.1 and the second engagement-over edge frangible location 68.2 are manually destroyed in that the first opening flap 63.5 is pressed inwardly in the direction of the eating utensil part engagement-behind support body 32. The pressing inwardly takes place about the first engagement-over edge hinge pivot axis 74.1 of the first engagement-over edge hinge 67.1 and about the second engagement-over edge hinge pivot axis 74.2 of the second engagement-over edge hinge 67.2 and, in particular, until the first opening flap 63.5 rests on the eating utensil engagement-behind support body 32 of the first handling part 27.1 (cf. FIGS. 9 and 10). So that this is possible, the first opening flap 63.5 has in the transverse center between the first engagement-over edge hinge 67.1 and the second engagement-over edge hinge 67.2 an opening 75 which is open at one side and formed as, for example, a slot. This has, as considered in the direction of the eating utensil part hinge pivot axis 36, an opening width which is greater than the diameter which, as considered in the same direction, spans the support pin 72, so that a pin part of the support pin 72 is receivable in the opening 75 (see FIG. 9).

The eating utensil part 30 is subsequently manually pivoted or folded from its non-use setting 37 about the eating utensil part hinge pivot axis 36 of the eating utensil part hinge 35 formed as a film hinge beyond the intermediate pivot setting 76, which is shown in FIG. 9, through approximately 180 degrees into its eating use setting 38 (see FIG. 10). The eating utensil part 30 then is opposite by its first eating utensil part side 34.1 the eating utensil part engagement-behind support body 32 and projects by its free eating utensil part end 41 out beyond the lid outer edge 26 (see FIGS. 10 and 11).

The second opening flap, thus the sixth container engagement-over edge part 63.6, of the closure lid 10 is subsequently manually detached. For this purpose, the third engagement-over edge frangible location 68.3 and the fourth engagement-over edge frangible location 68.4 are manually destroyed in that the second opening flap 63.6 is pressed inwardly in the direction of the body part 33, which is formed as an edge part, of the first handling part or middle part 27.1. The pressing inwardly takes place about the third engagement-over edge hinge pivot axis 74.3 of the third engagement-over edge hinge 67.3 and about the fourth engagement-over edge hinge pivot axis 74.4 of the fourth engagement-over edge hinge 67.4 and, in particular, until the second opening flap 63.6 rests on the body part 33, which is formed as an edge part, of the first handling part or middle part 27.1 (see FIG. 9).

The second handling part or the first closure half 27.2 is subsequently pivoted or folded about the first lid hinge pivot axis 51.1 of the first lid hinge 50.1 into its first handling setting 55.1 and the third handling part or the second closure half 27.3 is pivoted or folded about the second lid hinge pivot axis 51.2 of the second lid hinge 50.2 into its second handling setting 55.2, until these two handling parts or closure halves 27.2, 27.3 are each arranged at an angle of approximately 90 degrees to the first handling part or middle part 27.1 and extend approximately parallel to one another in the same directions away from the first handling part or middle part 27.1. In the context of this pivoting or folding movement the clamping means 69.1 of the second handling part 27.2 detents at or in the counter-clamping means 69.2 of the third handling part 27.3 so that then the second and third handling parts or the two closure halves 27.2, 27.3 are fixed to one another to be detachable again and in such a way that they cannot unintentionally fold back.

In these two handling settings 55.1, 55.2 the second and third handling parts or the first and second closure halves 27.2, 27.3 form, together with the first handling part or middle part 27.1, a complete handle 56 for operation of the eating utensil part 30 folded out into its eating use setting 38 (see FIGS. 10 and 11). In this handle 56 the first eating utensil part engagement-over support body 65.1 of the second handling part or the first closure half 27.2 and the second eating utensil part engagement-over support body 65.2 of the third handling part or the second closure half 27.3 are opposite the eating utensil part engagement-behind support body 32 of the first handling part 27.1 in the region of the outer edge thereof. Moreover, the first eating utensil part engagement-over support body 65.1 of the second handling part or the first closure half 27.2 and the second eating utensil part engagement-over support body 65.2 of the third handling part or the second closure half 27.3 are opposite the eating utensil part 30, which rests directly on the inwardly folded first opening flap 63.5, on its second eating utensil part side 34.2, which faces in an opposite direction away from the first eating utensil part side 34.1, and thus there bear directly against the eating utensil part 30 on its second eating utensil part side 34.2 (see FIG. 10). As a result, on the one hand use forces, which act in a first force direction 39.1 and which can be exerted by the eating utensil part 30 in use, are supported or accepted by way of the eating utensil part engagement-behind support body 32 of the first handling part or middle part 27.1 and on the on the other hand use forces, which act in an opposite, second and third force direction 39.2 and 39.3 and which can be exerted in use of the eating utensil part 30, are supported or accepted by the first eating utensil part engagement-over support body 65.1 of the second handling part or the first closure half 27.2 and by the second eating utensil part engagement-behind support body 65.2 of the first handling part or the second closure half 27.3.

Moreover, use forces, which act in any force directions 39.4 perpendicularly thereto, thus perpendicularly to the second force direction 39.2 and to the parallel third force direction 39.3, and which can be exerted in use of the eating utensil part 30, can be accepted by the eating utensil part hinge 35, by the lateral eating utensil part support bodies 57.1, 57.2 and above all also by way of the support pin 72 projecting by a pin part through the eating utensil part passage 48. In the case of the eating utensil 11, a pin part of the support pin 72 extends through the eating utensil part passage 48 of the eating utensil part 30, wherein the eating utensil part 30 is supported by way of passage edges of its eating utensil part passage 48 on the support pin 72 so that in the eating use setting 38 of the eating utensil part 30 the pin part is connected with the eating utensil part passage 48 in interlocking manner to be releasable again.

Accordingly, the eating utensil part 30 or the functional part 42 thereof, thus here the spoon basin (bowl), can be loaded with forces in all or any directions, wherein these forces can be advantageously absorbed by the handle 56 without folding back or unlatching of the eating utensil part 30 taking place.

By virtue of the afore-described production method it is possible for the eating utensil 11 shown in FIGS. 10 and 11 to be produced from the original closure lid 10. In this eating utensil 11 the eating utensil part 30 is folded out about the eating utensil part hinge pivot axis 35 into its eating use setting 38 for eating a content of a container 12. In the eating use setting 38 the eating utensil part 30 extends in the direction of its eating utensil part longitudinal axis 40 perpendicularly away from the eating utensil part hinge pivot axis 35 out beyond the lid outer edge 26 of the handling body 25. Moreover, when the fifth container engagement-over edge part or the first opening flap 63.5 is folded inwardly and subsequently the eating utensil part 30 is pivoted into its eating use setting 38 the eating utensil part engagement-behind support body 32 of the first handling part or the middle part 27.1 is opposite the eating utensil part 30 on a first eating utensil part side 34.1 of the eating utensil part 30, wherein then the fifth container engagement-over edge part or the first opening flap 63.5 is arranged between the eating utensil part 30 and the eating utensil part engagement-behind support body 32 so that then the eating utensil part 30 is directly supported on the eating utensil part engagement-behind support body 32 for acceptance of use forces acting in the first force direction 39.1.

In the eating utensil lithe second handling part or the first closure half 27.2 is disposed in its first handling setting 55.1 folded about the first lid hinge pivot axis 51.1 and the third handling part or the second closure half 27.3 is disposed in its second handling setting 55.2 folded about the second lid hinge pivot axis 51.2, in which the second handling part or the first closure half 27.2, the first handling part or the middle part 27.1 and the third handling part or the second closure half 27.3 form the handle 56 for manual operation of the eating utensil part 30, which is folded out into its eating use setting 38, for eating a content of the container 12. In that case, the first eating utensil part engagement-over support body 65.1 of the second handling part or the first closure half 27.2 is directly opposite the eating utensil part 30 on the second eating utensil part side 34.2, which faces away from the first eating utensil part side 34.1, of the eating utensil part 30 so that the eating utensil part 30 is supported on the first eating utensil part engagement-over support body 65.1 for acceptance of use forces acting in the second force direction 39.2 opposite to the first force direction 39.1. In addition, in the eating utensil 11 the second eating utensil part engagement-over support body 65.2 of the third handling part or the second closure half 27.3 is directly opposite the eating utensil part 30 on the second eating utensil part side 34.2, which faces away from the first eating utensil part side 34.1, of the eating utensil part 30 so that the eating utensil part 30 is supported on the second eating utensil part engagement-over support body 65.2 for acceptance of use forces acting in the third force direction 39.3 opposite to the first force direction 39.1. Finally, in the case of the eating utensil 11 the handling parts or the first and second closure halves 27.2, 27.3 are secured relative to the first handling part or the middle part 27.1 by way of the at least one securing means 69.1, 69.2 against unintended folding back. Stated in simple terms, the invention relates to an eating utensil 11 which is produced directly from the lid or closure 10 and, in particular, through folding or pivotation of lid parts of the lid or closure 10.

In summary, the invention can also be described as follows: In the presented solution, the actual lid or closure 10 of the container 12 is formed into an eating utensil part 30 and a handle 56 of the eating utensil part 30. The lid or closure 10 consists of an intrinsically stiff material, particularly of plastics material. The overall length can be increased to a ratio from 1 to approximately 1.9 by this folding procedure via hinges 35, 50.1, 50.2, which are preferably constructed as film hinges, without the individual parts having to be separated out. This is achieved in that the peelable, i.e. able to be pulled-off, cover 70, particularly IML foil (IML='In-Mold Labelling'), which closes the lid plane over the passages 46.1, 46.2, is partially or entirely pulled off and the eating utensil part 30, which comprises a functional part 42, of the eating utensil 11 is folded outwardly by way of an eating utensil part hinge 35, which is preferably constructed as a film hinge, of a middle part 27.1 through approximately 180 degrees. After the folding-out of the eating utensil part 30 pivotably connected with the middle part 27.1 the lefthand and righthand closure halves 27.2, 27.3 are pivoted by way of lid hinges 50.1, 50.2 relative to the middle part 27.1 and brought together over the folded-out eating utensil part 30 at a spacing from the eating utensil part hinge 35. The two closure halves 27.2, 27.3 temporarily detent to or with one another and form together with the middle part 27.1 a stable unit which can be used as a fully-fledged handle 56. Through the support of the eating utensil part 30, which is folded through approximately 180°, on the middle part 27.1 of the closure 10 and through the two lefthand and righthand closure halves 27.2, 27.3 folded thereover there is guarantee of maximum stiffness. The functional part 42 of the eating utensil 11 can be loaded by way of the handle 56 in all directions relative to the handle 56 without an undesired folding in or folding back of the eating utensil part 30 occurring. It is achieved by the folding via the hinge that the original lid or closure 10 is converted into an integral eating utensil 11. After use it is possible to convert this unit back into the lid or closure. The production of the lid or closure 10 according to the invention takes place in a one-step process, in which case the lid 10 can be made from only one raw material. However, it is also possible to produce the closure in a one-step process from different materials. Since the or each functional part 42 of the eating utensil 11 is part of the original lid or closure 10 and was not added as a separate part it is possible to save corresponding raw material. Moreover, each region of the eating utensil 11 can be adapted in simple manner in load-bearing capability by appropriate changes in thickness. The lid or cover 10 according to the invention can be recycled as a whole entirely as mono-material. The eating utensil part 30, particularly spoon, fork or knife, is accommodated within the cover or closure 10 for a container 12, for example cup, dish, bowl, wide-neck vessel or the like. There is no longer addition of single-use cutlery (cost reduction, preservation of the environment). The eating utensil part 30 can reach as far as the base of the container 12. The invention makes possible a high degree of stability for the removal of frozen and tough contents from a container 12 to be covered or closed.

Although only a few embodiments of the present invention have been shown and described, it is to be understood that many changes and modifications may be made thereunto without departing from the spirit and scope of the invention.

REFERENCE NUMERAL LIST

20 (closure) lid/closure
11 cutlery/eating utensil
12 container/packaging container/receptacle
13 container opening
14 container base
15 container circumferential wall
16 container cavity
17 rim
18 sealing membrane
19 container edge
20 closure means/inner edge
21 container engagement-over edge
22 spacer/spacer rib
23 lid body
24 lid edge
25 handling body
26 lid outer edge
26.1 lid outer edge of 27.1
27.1 first handling part
27.2 second handling part
27.3 third handling part
28.2 underside of 27.2
30 cutlery part/eating utensil part
31.1 first handling part end of 27.1
31.2 second handling part end of 27.1
32 eating utensil part engagement-behind support body (of 27.1)
33 body part (of 27.1)
34.1 first eating utensil part side
34.2 second eating utensil part side
35 eating utensil part hinge/cutlery part hinge/film hinge/hinge
36 eating utensil part hinge pivot axis
37 non-use setting
38 eating use setting
39.1 first force direction
39.2 second force direction
39.3 third force direction
39.4 force direction(s)
40 eating utensil part longitudinal axis
41 free eating utensil part end
42 (eating) functional part/spoon basin (bowl)
43 spoon stem
44 spoon
45 hinge spacing
46 eating utensil part receiving passage/passage
46.1 eating utensil part receiving passage/passage
46.2 eating utensil part receiving passage/passage
47 fixing means/connection
48 eating utensil part passage
49 inner surface of 32
50.1 first lid hinge/first lid film hinge/hinge
50.2 second lid hinge/second lid film hinge/hinge
51.1 first lid hinge pivot axis
51.2 second lid hinge pivot axis
52 center longitudinal axis of 27.1

53.1 first outer edge part
53.2 second outer edge part
53.3 third outer edge part
53.4 fourth outer edge part
54.1 (first) basic setting
54.2 (second) basic setting
55.1 (first) handling setting
55.2 (second) handling setting
56 grip/handle
57.1 abutment/support body/eating utensil part support body
57.2 abutment/support body/eating utensil part support body
58 longitudinal spacing
59 transverse spacing
60 eating utensil part width
62 inner cover surface of 23
63.1 first container engagement-over edge part
63.2 second container engagement-over edge part
63.3 third container engagement-over edge part
63.4 fourth container engagement-over edge part
63.5 fifth container engagement-over edge part/first opening flap
63.6 sixth container engagement-over edge part/second opening flap
64 upper outer surface of 23
65.1 first eating utensil part engagement-over support body of 63.1
65.2 second eating utensil part engagement-over support body of 63.2
66.1 first edge part of 63.3
66.2 second edge part of 63.4
67.1 first engagement-over edge hinge/film hinge
67.2 second engagement-over edge hinge/film hinge
67.3 third engagement-over edge hinge/film hinge
67.4 fourth engagement-over edge hinge/film hinge
68.1 first engagement-over edge frangible location
68.2 second engagement-over edge frangible location
69.1 first securing means/clamping means
69.2 second securing means/counter-clamping means
70 cover/cover foil
71 perforation/frangible location
72 support pin
73.1 first pin end of 72
73.2 second (free) pin end of 72
74.1 first engagement-over edge hinge pivot axis
74.2 second engagement-over edge hinge pivot axis
74.3 third engagement-over edge hinge pivot axis
74.4 fourth engagement-over edge hinge pivot axis
75 opening
76 intermediate pivot setting
77.1 first foil part of 70
77.2 second foil part of 70

What is claimed is:

1. A lid for a container, comprising:

a lid body comprising a handling body, which has a lid outer edge, and an eating utensil part, which is integrally connected with the handling body via a rectilinearly extending eating utensil part hinge in such a way that the eating utensil part can be folded out relative to the handling body about an eating utensil part hinge pivot axis of the eating utensil part hinge from a not-folded-out, non-use setting not intended for eating into an eating use setting which is for eating a content of the container and in which the eating utensil part extends in the direction of its eating utensil part longitudinal axis transversely away from the eating utensil part hinge beyond the lid outer edge of the handling body, wherein the handling body comprises a plurality of handling parts of which a first handling part and a second handling part are integrally connected together via a rectilinearly extending first lid hinge in such a way that the second handling part is foldable relative to the first handling part about at least one first lid hinge pivot axis of the first lid hinge from a basic setting not intended for eating into a first handling setting in which the handling parts form a handle for manual operation of the eating utensil part, which is folded out into its eating use setting, for eating the content of the container, wherein at least one securing means for securing the handling parts, which are folded together to form the handle, against unintended folding back is provided, wherein the eating utensil part hinge has a hinge spacing from the lid outer edge of the handling body, wherein an eating utensil part engagement-behind support body of the first handling part is formed between the eating utensil part hinge or the eating utensil part hinge pivot axis and the lid outer edge of the handling body and wherein the eating utensil part engagement-behind support body is opposite the eating utensil part in the eating use setting on a first eating utensil part side of the eating utensil part so that for acceptance of use forces acting in a first force direction the eating utensil part is supported on the eating utensil part engagement-behind support body, and wherein the second handling part is formed with a first eating utensil part engagement-over support body which in the first handling setting is opposite the eating utensil part in the eating use setting on a second eating utensil part side, which faces away from the first eating utensil part side, of the eating utensil part so that for acceptance of use forces acting in a second force direction opposite the first force direction the eating utensil part is supported on the first eating utensil part engagement-over support body.

2. The lid according to claim 1, wherein the eating utensil part in its not-folded-out, non-use setting not intended for eating is integrated in the lid body.

3. The lid according to claim 1, wherein the eating utensil part in its not-folded-out, non-use setting not intended for eating is completely surrounded by the lid outer edge of the handling body.

4. The lid according to claim 1, wherein the first handling part is constructed as an eating utensil part receiving part with an eating utensil part receiving passage in which the eating utensil part, which is pivotably connected by way of the eating utensil part hinge with the eating utensil part engagement-behind support body of the first handling part of the handling body, in its not-folded-out, non-use setting not intended for eating is arranged.

5. The lid according to claim 1, wherein the first lid hinge extends with interruption or without interruption continuously between a first outer edge part of the lid outer edge and a second outer edge part, which faces away from the first outer edge part, of the lid outer edge.

6. The lid according to claim 1, wherein a first eating utensil part support body and a second eating utensil part support body are arranged at the first handling part in the region of the lid outer edge of the handling body or at the lid outer edge of the handling body at a longitudinal spacing from the eating utensil part hinge to respectively adjoin the eating utensil part engagement-behind support body and as considered in a direction parallel to the eating utensil part hinge at a mutual transverse spacing the same size as or slightly larger than an eating utensil part width which the eating utensil part has in the longitudinal spacing from the eating utensil part hinge or wherein a first eating utensil part support body and a second eating utensil part support body are arranged at the second handling part in the region of the lid outer edge of the handling body or at the lid outer edge of the handling body at a longitudinal spacing from the eating utensil part hinge to respectively adjoin the eating utensil part engagement-over support body and as considered in a direction parallel to the eating utensil part hinge at a mutual longitudinal spacing the same size as or slightly larger than an eating utensil part width which the eating utensil part has in the longitudinal spacing from the eating utensil part hinge or wherein a first eating utensil part support body is arranged at the first handling part in the region of the lid outer edge of the handling body or at the lid outer edge of the handling body at a longitudinal spacing from the eating utensil part hinge to adjoin the eating utensil part engagement-behind support body and wherein a second eating utensil part support body is arranged at the second handling part in the region of the lid outer edge of the handling body or at the lid outer edge of the handling body at a longitudinal spacing from the eating utensil part hinge to adjoin the eating utensil part engagement-over support body, wherein the first eating utensil part support body and the second eating utensil part support body in the handling setting in which the first handling part and the second part are folded to form the handle are, as considered in a direction parallel to the eating utensil part hinge, arranged at a mutual longitudinal spacing the same size as or slightly larger than an eating utensil part width which the eating utensil part has in the longitudinal spacing from the eating utensil part hinge.

7. The lid according to claim 1, wherein attached to the eating utensil part engagement-behind support body of the first handling part is a support pin which extends transversely away from an inner surface of the eating utensil part engagement-behind support body up to its free pin end and wherein the eating utensil part has an eating utensil part passage for reception of a pin part of the support pin, through which in the eating use setting of the eating utensil part the pin part of the support pin extends so that in the eating use setting of the eating utensil part the eating utensil part is either supportable on the pin by way of passage edges of its eating utensil part passage or is supported on the support pin by way of passage edges of its eating utensil part passage.

8. The lid according to claim 1, wherein the handling body comprises a third handling part, which is integrally connected by way of a rectilinearly extending second lid hinge with the first handling part in such a way that the third handling part is foldable relative to the first handling part about a second lid hinge pivot axis, which extends parallel to the first lid hinge pivot axis, of the second lid hinge from a second basic setting not intended for eating into a second handling setting, wherein the second handling part in its first handling setting and the third handling part in its second handling setting form together with the first handling part the handle for manual operation of the eating utensil part, which is folded out into its eating use setting, for eating the content of the container, and wherein the third handling part comprises a second eating utensil engagement-over support body which in the second handling setting of the third handling part is opposite the eating utensil part in the eating use setting on the second eating utensil side, which faces away from the first eating utensil side, of the eating utensil part so that for acceptance of use forces acting in a third force direction opposite to the first force direction the eating utensil part is supported on the second eating utensil engagement-over support body.

9. The lid according to claim 8, wherein the second handling part and the third handling part each have an outer profile formed symmetrically with respect to a center longitudinal axis of the first handling part.

10. The lid according to claim 8, wherein the second lid hinge extends with interruption or without interruption continuously between a third outer edge part of the lid outer edge and a fourth outer edge part, which faces away from the third outer edge part, of the lid outer edge.

11. The lid according to claim 8, wherein the first handling part and/or the second handling part and/or the third handling part is or are provided with abutments which on folding-over of the second handling part relative to the first handling part about the first lid hinge pivot axis of the first lid hinge and on folding-over of the third handling part relative to the first handling part about the second lid hinge pivot axis of the second lid hinge enables or enable abutment in each instance in an angular setting corresponding with an angle.

12. The lid according to claim 8, further comprising a container engagement-over edge, which is partly or completely encircling and which extends in a direction transversely to an inner cover surface of the lid body out beyond the inner cover surface, for engagement over a container edge of the container to be covered or closed by means of the lid, wherein the container engagement-over edge has a first container engagement-over edge part associated with the second handling part and a second container engagement-over edge part associated with the third handling part, and wherein the first eating utensil engagement-over support body of the second handling part is a component of the first container engagement-over edge part and wherein the second eating utensil engagement-over support body of the third handling part is a component of the second container engagement-over edge part and wherein the container engagement-over edge has a third container engagement-over edge part associated with the second handling part and a fourth container engagement-over edge part associated with the third handling part, wherein the third container engagement-over edge part has a first edge part which in the first handling setting is opposite a body part of the first handling part and wherein the fourth container engagement-over edge part has a second edge part which in the second handling setting is opposite the body part of the first handling part.

13. The lid according to claim 12, wherein a fifth container engagement-over edge part of the container engagement-over edge and the first handling part are integrally connected by way of a first engagement-over edge hinge arranged in the region of the first eating utensil part engagement-over support body, and wherein the fifth container engagement-over edge part and the first container engagement-over edge part are connected by way of a manually destructible first engagement-over edge frangible location and wherein the fifth container engagement-over edge part and the second container engagement-over edge part are connected by way of a manually destructible second engagement-over edge frangible location and wherein a sixth container engagement-over edge part of the container engagement-over edge and the first handling part are integrally connected by way of a second engagement-over edge hinge arranged in the region of the body part of the first handling part and wherein the sixth container engagement-over edge part and the third container engagement-over edge part are connected by way of a manually destructible third engagement-over edge frangible location and wherein the sixth container engagement-over edge part and the fourth container engagement-over edge part are connected by way of manually destructible fourth engagement-over edge frangible location, so that after destruction of the first engagement-over edge frangible location and the second engagement-over edge frangible location the fifth container engagement-over edge part is foldable away outwardly or inwardly about a first engagement-over edge hinge pivot axis of the first engagement-over edge hinge and after destruction of the third engagement-over edge frangible location and the fourth engagement-over edge frangible location the sixth container engagement-over edge part is foldable away outwardly or inwardly about a second engagement-over edge hinge pivot axis of the second engagement-over edge hinge, so that the second handling part is foldable about the first lid hinge pivot axis of the first lid hinge and the third handling part about the second lid hinge pivot axis of the second lid hinge relative to one another to form the handle.

14. An eating utensil which is produced from the lid according to claim 1, wherein the eating utensil part is folded out about the eating utensil part hinge pivot axis of the eating utensil part hinge into its eating use setting for eating the content of the container, in which the eating utensil part extends in the direction of its eating utensil part longitudinal axis transversely away from the eating utensil part hinge pivot axis out beyond the lid outer edge of the handling body and in which the eating utensil part engagement-behind support body of the first handling part either is opposite the eating utensil part on the first eating utensil part side of the eating utensil part so that for acceptance of use forces acting in the first force direction the eating utensil part is supported on the eating utensil part engagement-behind support body or bears against the eating utensil part on the first eating utensil part side of the eating utensil part so that for acceptance of use forces acting in the first force direction the eating utensil part is supported on the eating utensil part engagement-behind support body, and wherein the first handling part and the second handling part in their first handling setting are folded about the first lid hinge pivot axis of the first lid hinge, in which the first handling part and the second handling part form the handle for manual operation of the eating utensil part, which is folded out into its eating use setting, for eating the content of the container and in which the first eating utensil part engagement-over support body of the second handling part either is opposite the eating utensil part on the second eating utensil part side, which faces away from the first eating utensil part side, of the eating utensil part so that for acceptance of use forces acting in the second force direction opposite to the first force direction the eating utensil part is supported on the first eating utensil part engagement-over support body or bears against the eating utensil part on the second eating utensil part side, which faces away from the first eating utensil part side, of the eating utensil part so that for acceptance of use forces acting in the second force direction opposite to the first force direction the eating utensil part is supported on the eating utensil part engagement-over support body and in which the second handling part and a third handling part are secured by way of the at least one securing means against unintended folding back.

15. An eating utensil which is produced from the lid according to claim 8, wherein the eating utensil part is folded out about the eating utensil part hinge pivot axis of the eating utensil part hinge into its eating use setting for eating the content of the container, in which the eating utensil part extends in the direction of its eating utensil part longitudinal axis transversely away from the eating utensil part hinge pivot axis out beyond the lid outer edge of the handling body and in which the eating utensil part engagement-behind support body of the first handling part either is opposite the eating utensil part on the first eating utensil part side of the eating utensil part so that for acceptance of use forces acting in the first force direction the eating utensil part is supported on the eating utensil part engagement-behind support body or bears against the eating utensil part on the first eating utensil part side of the eating utensil part so that for acceptance of use forces acting in the first force direction the eating utensil part is supported on the eating utensil part engagement-behind support body, and wherein the second handling part is disposed in its first handling setting folded about the first lid hinge pivot axis of the first lid hinge and the third handling part is disposed in its second handling setting folded about the second lid hinge pivot axis of the second lid hinge, in which the second handling part, the first handling part and the third handling part form the handle for manual operation of the eating utensil part, which is folded out into its eating use setting, for eating the content of the container, and in which the first eating utensil part engagement-over support body of the second handling part either is opposite the eating utensil part on the second eating utensil part side, which faces away from the first eating utensil part side, of the eating utensil part so that for acceptance of use forces acting in the second force direction opposite to the first force direction the eating utensil part is supported on the first eating utensil part engagement-over support body or bears against the eating utensil part on the second eating utensil part side, which faces away from the first eating utensil part side, of the eating utensil part so that for acceptance of use forces acting in the second force direction opposite to the first force direction the eating utensil part is supported on the eating utensil part engagement-over support body, and in which the second eating utensil part engagement-over support body of the third handling part either is opposite the eating utensil part on the second eating utensil part side which faces away from the first eating utensil part side, of the eating utensil part so that for acceptance of use forces acting in the third force direction opposite to the first force direction the eating utensil part is supported on the second eating utensil part engagement-over support body or bears against the eating utensil part on the second eating utensil part side, which faces away from the first eating utensil part side, of the eating utensil part so that for acceptance of use forces acting in the third force direction opposite to the first force direction the eating utensil part is supported on the eating utensil part engagement-over support body and in which the second and third handling parts are secured by way of the at least one securing means against unintended folding back.

* * * * *